US011124207B2

(12) United States Patent
Naithani et al.

(10) Patent No.: US 11,124,207 B2
(45) Date of Patent: Sep. 21, 2021

(54) OPTICAL ROUTE EXAMINATION SYSTEM AND METHOD

(71) Applicant: GENERAL ELECTRIC COMPANY, Schenectady, NY (US)

(72) Inventors: Nidhi Naithani, Bangalore (IN); Dattaraj Jagdish Rao, Bangalore (IN); Anju Bind, Bangalore (IN); Sreyashi Dey Chaki, Bangalore (IN)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 1123 days.

(21) Appl. No.: 14/217,672

(22) Filed: Mar. 18, 2014

(65) Prior Publication Data

US 2015/0268172 A1 Sep. 24, 2015

(51) Int. Cl.

| | |
|---|---|
| ***B61K 9/08*** | (2006.01) |
| ***B61L 23/04*** | (2006.01) |
| ***B61L 25/02*** | (2006.01) |

(52) U.S. Cl.

CPC ..... *B61K 9/08* (2013.01); *B61L 23/041* (2013.01); *B61L 23/047* (2013.01); *B61L 23/048* (2013.01); *B61L 25/025* (2013.01)

(58) Field of Classification Search

CPC ..... B61K 9/08; B61L 23/041; B61L 23/047; B61L 23/048; B61L 25/025

USPC ..... 348/129

See application file for complete search history.

(56) References Cited

U.S. PATENT DOCUMENTS

| | | | |
|---|---|---|---|
| 2,701,610 | A | 2/1955 | Carlson |
| 3,505,742 | A | 4/1970 | Fiechter |
| 3,581,071 | A | 5/1971 | Payseure |
| 3,641,338 | A | 2/1972 | Peel et al. |
| 3,864,039 | A | 2/1975 | Wilmarth |
| 4,259,018 | A | 3/1981 | Poirier |
| 4,281,354 | A | 7/1981 | Conte |
| 4,490,038 | A | 12/1984 | Riessberger et al. |

(Continued)

FOREIGN PATENT DOCUMENTS

| | | | |
|---|---|---|---|
| CN | 201325416 | Y | 10/2009 |
| CN | 201821456 | U | 5/2011 |

(Continued)

OTHER PUBLICATIONS

PCT Search Report and Written Opinion issued in connection with corresponding PCT Application No. PCT/US2015/016151 dated May 27, 2015.

(Continued)

*Primary Examiner* — Eileen M Adams

(74) *Attorney, Agent, or Firm* — Mary D. Lawlor; The Small Patent Law Group LLC

(57) ABSTRACT

A method for optically examining a route such as a track includes obtaining one or more images of a segment of a track from a camera mounted to a rail vehicle while the rail vehicle is moving along the track and selecting a benchmark visual profile of the segment of the track. The benchmark visual profile represents a designated layout of the track. The method also can include comparing the one or more images of the segment of the track with the benchmark visual profile of the track and identifying one or more differences between the one or more images and the benchmark visual profile as a misaligned segment of the track.

22 Claims, 10 Drawing Sheets

(56) References Cited

U.S. PATENT DOCUMENTS 4,654,973 A 4/1987 Worthy
4,751,571 A 6/1988 Lillquist
4,783,593 A 11/1988 Noble
4,915,504 A 4/1990 Thurston
5,203,089 A 4/1993 Centil et al.
5,337,289 A 8/1994 Fasching et al.
5,364,047 A 11/1994 Petit et al.
5,379,224 A 1/1995 Brown et al.
5,429,329 A 7/1995 Wallace et al.
5,506,682 A 4/1996 Pryor
RE35,590 E 8/1997 Bezos et al.
5,659,305 A 8/1997 Rains et al.
5,717,737 A 2/1998 Doviak et al.
5,729,213 A 3/1998 Ferrari et al.
5,735,492 A 4/1998 Pace
5,786,750 A 7/1998 Cooper
5,793,420 A 8/1998 Schmidt
5,867,122 A 2/1999 Zahm et al.
5,867,404 A 2/1999 Bryan
5,867,717 A 2/1999 Milhaupt et al.
5,893,043 A 4/1999 Moehlenbrink et al.
5,938,717 A 8/1999 Dunne et al.
5,954,299 A 9/1999 Pace
5,961,571 A 10/1999 Gorr et al.
5,978,718 A 11/1999 Kull
6,011,901 A 1/2000 Kirsten
6,081,769 A 6/2000 Curtis
6,088,635 A 7/2000 Amet et al.
6,128,558 A 10/2000 Kernwein
6,150,930 A 11/2000 Cooper
6,163,755 A * 12/2000 Peer ..... B61L 23/041 340/436
6,259,375 B1 7/2001 Andras
6,263,266 B1 7/2001 Hawthorne
6,356,299 B1 3/2002 Trosino et al.
6,373,403 B1 4/2002 Korver et al.
6,377,215 B1 4/2002 Halvorson et al.
6,384,742 B1 5/2002 Harrison
6,453,056 B2 9/2002 Laumeyer et al.
6,453,223 B1 9/2002 Kelly et al.
6,487,500 B2 11/2002 Lemelson et al.
6,519,512 B1 2/2003 Haas et al.
6,526,352 B1 2/2003 Breed et al.
6,532,035 B1 3/2003 Saari et al.
6,532,038 B1 3/2003 Haring et al.
6,570,497 B2 5/2003 Puckette et al.
6,600,999 B2 7/2003 Clark et al.
6,631,322 B1 10/2003 Arthur et al.
6,637,703 B2 10/2003 Matheson et al.
6,647,891 B2 11/2003 Holmes et al.
6,712,312 B1 3/2004 Kucik
6,778,284 B2 8/2004 Casagrande
6,831,573 B2 12/2004 Jones
6,995,556 B2 2/2006 Nejikovsky et al.
7,039,367 B1 5/2006 Kucik
7,348,895 B2 3/2008 Lagassey
7,403,296 B2 7/2008 Farritor et al.
7,463,348 B2 12/2008 Chung
7,493,202 B2 2/2009 Demro et al.
7,527,495 B2 5/2009 Yam et al.
7,545,322 B2 6/2009 Newberg et al.
7,571,051 B1 8/2009 Shulman
7,616,329 B2 11/2009 Villar et al.
7,659,972 B2 2/2010 Magnus et al.
7,707,944 B2 5/2010 Bounds
7,742,873 B2 6/2010 Agnew et al.
7,772,539 B2 * 8/2010 Kumar ..... B61L 23/041 250/208.1
7,826,969 B2 11/2010 Hein et al.
7,845,504 B2 12/2010 Davenport et al.
7,908,114 B2 3/2011 Ruggiero
7,965,312 B2 6/2011 Chung et al.
7,999,848 B2 8/2011 Chew
8,180,590 B2 5/2012 Szwilski et al.
8,233,662 B2 7/2012 Bhotika et al.
8,335,606 B2 12/2012 Mian et al.
8,355,834 B2 1/2013 Duggan et al.
8,412,393 B2 4/2013 Anderson et al.
8,405,837 B2 5/2013 Villar et al.
8,576,069 B2 11/2013 Nadeem et al.
8,599,005 B2 12/2013 Fargas et al.
8,649,917 B1 2/2014 Abernathy
8,712,610 B2 4/2014 Kumar
8,744,196 B2 6/2014 Sharma et al.
8,751,073 B2 6/2014 Kumar et al.
8,838,301 B2 9/2014 Makkinejad
8,903,574 B2 12/2014 Cooper et al.
8,942,426 B2 * 1/2015 Bar-Am ..... B61K 9/08 104/242
9,049,433 B1 * 6/2015 Prince ..... G06T 7/001
9,108,640 B2 8/2015 Jackson
2001/0050324 A1 12/2001 Greene, Jr.
2002/0003510 A1 1/2002 Shigetomi
2002/0006231 A1 * 1/2002 Jayant ..... G06T 3/403 382/266
2002/0007225 A1 1/2002 Costello et al.
2002/0031050 A1 3/2002 Blevins et al.
2002/0035417 A1 3/2002 Badger et al.
2002/0037104 A1 3/2002 Myers et al.
2002/0101509 A1 8/2002 Slomski
2002/0135471 A1 9/2002 Corbitt et al.
2003/0048193 A1 3/2003 Puckette et al.
2003/0140509 A1 * 7/2003 Casagrande ..... B61K 9/08 33/287
2003/0142297 A1 7/2003 Casagrande
2003/0202101 A1 10/2003 Monroe et al.
2004/0056182 A1 * 3/2004 Jamieson ..... B61L 23/041 250/221
2004/0064241 A1 4/2004 Sekiguchi
2004/0093196 A1 5/2004 Hawthorne et al.
2004/0182970 A1 9/2004 Mollet et al.
2004/0263624 A1 12/2004 Nejikovsky et al.
2005/0012745 A1 1/2005 Kondo et al.
2005/0018748 A1 1/2005 Ringermacher et al.
2005/0110628 A1 5/2005 Kernwein et al.
2005/0113994 A1 5/2005 Bell et al.
2005/0125113 A1 6/2005 Wheeler et al.
2005/0174582 A1 * 8/2005 Carr ..... B61K 9/08 356/614
2005/0284987 A1 12/2005 Kande et al.
2006/0017911 A1 * 1/2006 Villar ..... B61K 9/08 356/4.01
2006/0132602 A1 6/2006 Muto et al.
2006/0244830 A1 11/2006 Davenport et al.
2007/0005202 A1 1/2007 Breed
2007/0027583 A1 2/2007 Tamir et al.
2007/0085703 A1 4/2007 Clark et al.
2007/0170315 A1 7/2007 Manor et al.
2007/0200027 A1 8/2007 Johnson
2007/0216771 A1 9/2007 Kumar
2007/0217670 A1 9/2007 Bar-Am
2007/0284474 A1 12/2007 Olson et al.
2008/0169939 A1 7/2008 Dickens et al.
2008/0304065 A1 12/2008 Hesser et al.
2009/0020012 A1 1/2009 Holten et al.
2009/0037039 A1 2/2009 Yu et al.
2009/0144233 A1 6/2009 Grigsby et al.
2009/0189981 A1 7/2009 Siann et al.
2009/0314883 A1 12/2009 Arlton et al.
2010/0039514 A1 2/2010 Brand
2010/0073480 A1 3/2010 Hoek et al.
2011/0064273 A1 * 3/2011 Zarembski ..... B61K 9/08 382/104
2011/0115913 A1 5/2011 Lang et al.
2011/0216200 A1 9/2011 Chung et al.
2011/0285842 A1 11/2011 Davenport et al.
2012/0089537 A1 4/2012 Cooper et al.
2012/0192756 A1 8/2012 Miller et al.
2012/0263342 A1 10/2012 Haas et al.
2012/0274772 A1 * 11/2012 Fosburgh ..... B61K 9/08 348/149
2012/0300060 A1 11/2012 Farritor
2013/0018766 A1 1/2013 Christman

(56) References Cited

U.S. PATENT DOCUMENTS

| | | | | |
|---|---|---|---|---|
| 2013/0191070 | A1 | 7/2013 | Kainer et al. | |
| 2013/0233964 | A1 | 9/2013 | Woodworth et al. | |
| 2013/0286204 | A1 | 10/2013 | Cheng | |
| 2014/0003724 | A1* | 1/2014 | Feris | G06T 7/2053 382/197 |
| 2014/0012438 | A1 | 1/2014 | Shoppa et al. | |
| 2014/0036063 | A1 | 2/2014 | Kim et al. | |
| 2014/0036076 | A1* | 2/2014 | Nerayoff | H04N 7/181 348/148 |
| 2014/0067167 | A1 | 3/2014 | Levien et al. | |
| 2014/0071269 | A1 | 3/2014 | Mohamed et al. | |
| 2014/0129154 | A1 | 5/2014 | Cooper et al. | |
| 2014/0142868 | A1 | 5/2014 | Bidaud | |
| 2014/0151512 | A1 | 6/2014 | Cooper et al. | |
| 2014/0266882 | A1 | 9/2014 | Metzger | |

FOREIGN PATENT DOCUMENTS

| | | | |
|---|---|---|---|
| DE | 19529986 | A1 | 2/1997 |
| DE | 19938267 | A1 | 2/2001 |
| DE | 102005029956 | A1 | 2/2006 |
| EP | 0093322 | A2 | 11/1983 |
| EP | 0117763 | A2 | 9/1984 |
| EP | 0378781 | A1 | 7/1990 |
| EP | 0605848 | A1 | 7/1994 |
| EP | 0761522 | A1 | 3/1997 |
| EP | 0893322 | A1 | 1/1999 |
| EP | 0953491 | A1 | 3/1999 |
| EP | 953491 | A1 | 11/1999 |
| EP | 1236634 | A1 | 9/2002 |
| EP | 1600351 | A1 | 11/2005 |
| GB | 2384379 | A | 7/2003 |
| GB | 2403861 | A | 1/2005 |
| JP | H05247903 | A | 9/1993 |
| JP | H08136254 | A | 5/1996 |
| JP | 2006298041 | A | 11/2006 |
| JP | 2008502538 | A | 1/2008 |
| JP | 2008247154 | A | 10/2008 |
| KR | 20130119633 | A | 11/2013 |
| KR | 20140017735 | A | 2/2014 |
| WO | 02058984 | A1 | 8/2002 |
| WO | 2005120924 | A1 | 12/2005 |
| WO | 2006112959 | A2 | 10/2006 |
| WO | 2007096273 | A1 | 8/2007 |
| WO | 2012150591 | A2 | 11/2012 |
| WO | 2013086578 | A1 | 6/2013 |
| WO | 2013121344 | A2 | 8/2013 |

OTHER PUBLICATIONS

Nicholls et al., "Applying Visual Processing to GPS Mapping of Trackside Structures," Proc. 9th British Machine Vision Conference, Southampton, pp. 841-851, 1998.

Saab A Map Matching Approach for Train Positioning Part I: Development and Analysis, IEEE Transactions on Vehicular Technology, vol. No. 49, Issue No. 2, pp. 467-475, Mar. 2000.

Oertel et al., "A Video-Based Approach for Stationary Platform Supervision", Intelligent Transportation Systems, 2002 Proceedings of IEEE 5th International Conference, pp. 892-897, 2002.

Stella et al., "Visual Recognition of Missing Fastening Elements for Railroad Maintenance", Intelligent Transportation Systems, The IEEE 5th International Conference, pp. 94-99, 2002.

Kim et al., "Pseudo-Real Time Activity Detection for Railroad Grade Crossing Safety", Intelligent Transportation Systems Proceedings of IEEE, vol. No. 2, pp. 1355-1361, 2003.

Hirokawa et al., "Threading the Maze," GPS World, pp. 20-26, Nov. 2004.

U.S. Non-Final Office Action issued in connection with related U.S. Appl. No. 10/361,968 dated Aug. 30, 2006.

PCT Search Report and Written Opinion issued in connection with related PCT Application No. PCT/US2005/039829 dated Mar. 22, 2007.

U.S. Final Office Action issued in connection with related U.S. Appl. No. 10/361,968 dated Apr. 24, 2007.

PCT Search Report and Written Opinion issued in connection with related PCT Application No. PCT/US2007/068780 dated Jan. 2, 2008.

PCT Search Report and Written Opinion issued in connection with related PCT Application No. PCT/US2008/061478 dated Jul. 24, 2008.

Unofficial English Translation of Mexican Office Action issued in connection with related MX Application No. 2003/004888 dated Sep. 10, 2008.

Eden et al., "Using 3d Line Segments for Robust and Efficient Change Detection from Multiple Noisy Images", Computer Vision—ECCV 2008, Springer Berlin Heidelberg, pp. 172-185, 2008.

Zerbst et al., "Damage Tolerance Investigations on Rails", Engineering Fracture Mechanics, vol. No. 76, Issue No. 17, pp. 2637-2653, 2009.

Rahmani et al., "A Novel Network Design for Future IP-Based Driver Assistance Camera Systems", Networking, Sensing and Control, 2009. ICNSC '09. International Conference on, IEEE Xplore, pp. 457-462, Mar. 2009.

European Office Action issued in connection with related EP Application No. 07783663.3 dated Jun. 10, 2009.

Kaleli et al., "Vision-Based Railroad Track Extraction Using Dynamic Programming", Proceedings of the 12th International IEEE Conference on Intelligent Transportation Systems, pp. 42-47, Oct. 2009.

Oh et al., "Performance Analysis of Vision Based Monitoring System for Passenger's Safety on Railway Platform", International Conference on Control Automation and Systems (ICCAS), 2010 International Conference, pp. 1867-1870, 2010.

Rutzinger et al., "Change Detection of Building Footprints from Airborne Laser Scanning Acquired in Short Time Intervals", pp. 475-480, Jul. 5, 2010.

Unofficial English Translation of Chinese Office Action issued in connection with related CN Application No. 200780024969.0 dated Jul. 26, 2010.

U.S. Non-Final Office Action issued in connection with related U.S. Appl. No. 11/146,831 dated Sep. 21, 2010.

Masuko et al., "Autonomous Takeoff and Landing of an Unmanned Aerial Vehicle", System Integration (SII), 2010 IEEE/SICE International Symposium on, pp. 248-253, Dec. 21-22, 2010.

U.S. Non-Final Office Action issued in connection with related U.S. Appl. No. 11/479,559 dated Feb. 3, 2011.

U.S. Non-Final Office Action issued in connection with related U.S. Appl. No. 11/750,681 dated May 18, 2011.

Guofang et al., "Research on Real-Time Location-Tracking of Underground Mine Locomotive Based on Wireless Mobile Video", Mechatronic Science, Electric Engineering and Computer (MEC), 2011 International Conference on, IEEE Xplore, pp. 625-627, Aug. 19-22, 2011.

U.S. Final Office Action issued in connection with related U.S. Appl. No. 11/479,559 dated Aug. 16, 2011.

U.S. Final Office Action issued in connection with related U.S. Appl. No. 11/750,681 dated Oct. 14, 2011.

Li et al., "A Real-Time Visual Inspection System for Discrete Surface Defects of Rail Heads", IEEE Transactions on Instrumentation and Measurement, vol. No. 61, Issue No. 8, pp. 2189-2199, 2012.

U.S. Non-Final Office Action issued in connection with related U.S. Appl. No. 13/194,517 dated Dec. 19, 2012.

U.S. Final Office Action issued in connection with related U.S. Appl. No. 13/194,517 dated Jul. 15, 2013.

Stent et al., "An Image-Based System for Change Detection on Tunnel Linings", 13th IAPR International Conference on Machine Vision Applications, 2013.

PCT Search Report and Written Opinion issued in connection with related PCT Application No. PCT/US2015/013720 dated Apr. 28, 2015.

PCT Search Report and Written Opinion issued in connection with related PCT Application No. PCT/US2015/013735 dated May 1, 2015.

(56) References Cited

OTHER PUBLICATIONS

PCT Search Report and Written Opinion issued in connection with related PCT Application No. PCT/ US2015/014355 dated May 15, 2015.
U.S. Non-Final Office Action issued in connection with related U.S. Appl. No. 14/479,847 dated Jun. 10, 2015.
U.S. Non-Final Office Action issued in connection with related U.S. Appl. No. 14/479,847 dated Nov. 18, 2015.
U.S. Non-Final Office Action issued in connection with related U.S. Appl. No. 14/253,294 dated Dec. 30, 2015.
U.S. Non-Final Office Action issued in connection with related U.S. Appl. No. 14/479,847 dated Apr. 21, 2016.
U.S. Non-Final Office Action issued in connection with related U.S. Appl. No. 14/485,398 dated Jun. 15, 2016.
European Search Report and Opinion issued in connection with corresponding EP Application No. 15184083.2 dated Jun. 16, 2016.
U.S. Final Office Action issued in connection with related U.S. Appl. No. 14/253,294 dated Jul. 14, 2016.
Office Action dated Nov. 3, 2020 for corresponding Chinese Patent Application No. 2019108511987 (7 pages).
English translation of the Office Action dated Nov. 3, 2020 for corresponding Chinese Patent Application No. 2019108511987 (5 pages).
Examination Report dated Nov. 5, 2020 for corresponding Australian Patent Application No. 2019205977 (5 pages).
Japanese Office Action for corresponding JP Application No. 2015-041910 dated Apr. 15, 2019 (6 pages).
Office Action dated Dec. 21, 2020 for corresponding Japanese application No. 2019-196715. (4 pages).
English translation of the Office Action dated Dec. 21, 2020 for corresponding Japanese application No. 2019-196715. (4 pages).
Office Action dated Sep. 9, 2019 for corresponding JP Application No. 2015-173383.
English Translation of the Office Action dated Sep. 9, 2019 for corresponding JP Application No. 2015-173383.
Australian Examination Report dated Jul. 31, 2020 for corresponding Application No. 2019205977. (5 Pages).

* cited by examiner

OPTICAL ROUTE EXAMINATION SYSTEM AND METHOD

FIELD

Embodiments of the subject matter disclosed herein relate to examining routes traveled by vehicles for damage to the routes.

BACKGROUND

Routes that are traveled by vehicles may become damaged over time with extended use. For example, tracks on which rail vehicles travel may become misaligned due to shifting of underlying ballast material, side-to-side rocking of the rail vehicles, and the like. The tracks may slightly bend or otherwise move out of the original alignment of the tracks. While the distance between the rails of the track (i.e., the gauge) may remain the same, the bending of the tracks from the original locations of the tracks can cause the tracks to shift out of alignment with the original locations. This shifting can pose threats to the safety of the rail vehicles, the passengers located thereon, and nearby persons and property. For example, the risks of derailment of the rail vehicles can increase when the tracks become misaligned.

Some known systems and methods that inspect the tracks involve emitting visible markers on the tracks and optically monitoring these markers to determine if the tracks have become misaligned. These visible markers may be created using laser light, for example. But, these systems and methods can require additional hardware in the form of a light emitting apparatus, such as a laser light source. This additional hardware increases the cost and complexity of the systems, and can require specialized rail vehicles that are not used for the conveyance of passengers or cargo. Additionally, these systems and methods typically require the rail vehicle to slowly travel over the tracks so that the visible markers can be examined.

Some rail vehicles include collision avoidance systems that seek to warn operators of the rail vehicles of foreign objects on the tracks ahead of the rail vehicles. These systems, however, may only include a camera that provides a video feed to an onboard operator. This operator manually inspects the video for any foreign objects and responds accordingly when a foreign object is identified by the operator. These types of systems are prone to human error.

BRIEF DESCRIPTION

In one example of the inventive subject matter described herein, a method (e.g., for optically examining a route such as a track) includes obtaining one or more images of a segment of a track from a camera mounted to a rail vehicle while the rail vehicle is moving along the track and selecting (with one or more computer processors) a benchmark visual profile of the segment of the track. The benchmark visual profile represents a designated layout of the track. The method also can include comparing (with the one or more computer processors) the one or more images of the segment of the track with the benchmark visual profile of the track and identifying (with the one or more computer processors) one or more differences between the one or more images and the benchmark visual profile as a misaligned segment of the track.

In another example of the inventive subject matter described herein, a system (e.g., an optical route examining system) includes a camera and one or more computer processors. The camera is configured to be mounted to a rail vehicle and to obtain one or more images of a segment of a track while the rail vehicle is moving along the track. The one or more computer processors are configured to select a benchmark visual profile of the segment of the track that represents a designated layout of the track. The one or more computer processors also are configured to compare the one or more images of the segment of the track with the benchmark visual profile of the track to identify one or more differences between the one or more images and the benchmark visual profile as a misaligned segment of the track.

In another example of the inventive subject matter described herein, a method (e.g., an optical route examining method) includes obtaining plural first images of an upcoming segment of a route with one or more cameras on a vehicle that is moving along the route, examining the first images with one or more computer processors to identify a foreign object on or near the upcoming segment of the route, identifying one or more differences between the first images with the one or more processors, determining if the foreign object is a transitory object or a persistent object based on the differences between the first images that are identified, and implementing one or more mitigating actions responsive to determining if the foreign object is the transitory object or the persistent object.

In another example of the inventive subject matter described herein, a system (e.g., an optical route examining system) includes one or more cameras configured to be mounted on a vehicle and to obtain plural first images of an upcoming segment of a route while the vehicle is moving along the route. The system also includes one or more computer processors configured to compare the first images with each other to identify differences between the first images, to identify a foreign object on or near the upcoming segment of the route based on the differences between the first images that are identified, to determine if the foreign object is a transitory object or a persistent object based on the differences between the first images that are identified, and to implement one or more mitigating actions responsive to determining if the foreign object is the transitory object or the persistent object.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Figure 1:
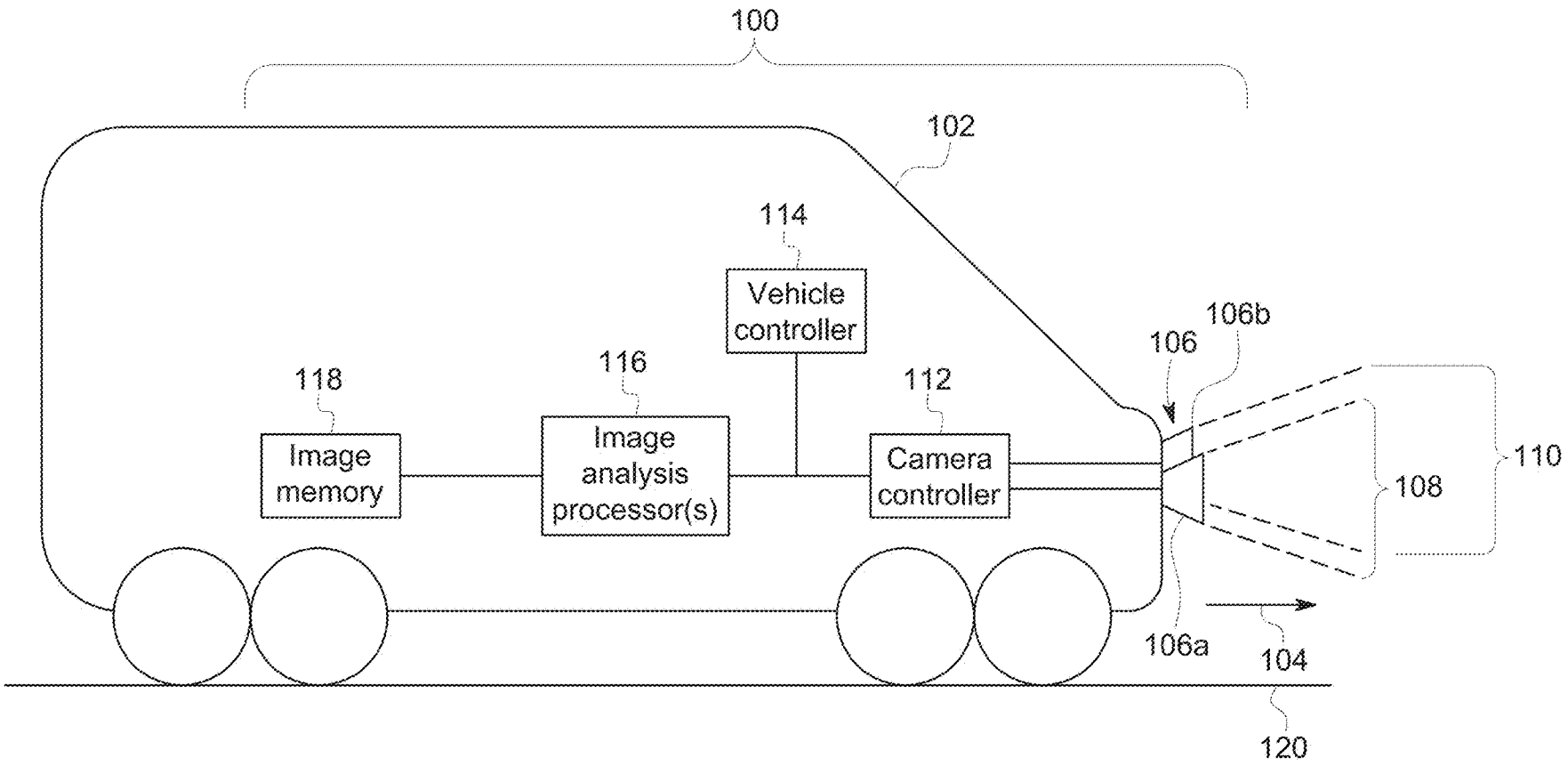
FIG. 1 is a schematic illustration of an optical route examination system in accordance with one example of the inventive subject matter described herein.

One or more examples of the inventive subject matter described herein include systems and methods for detecting misalignment of track traveled by rail vehicles. The systems and methods can use analysis of images of the track that are collected from a camera on the rail vehicle to detect this misalignment. Based on the detected misalignment, an operator of the rail vehicle can be alerted so that the operator can implement one or more responsive actions, such as by slowing down and/or stopping the rail vehicle.

The images of the track can be captured from a camera mounted on a rail vehicle, such as a locomotive. The camera can be oriented toward (e.g., pointing toward) the track in the direction of motion of the rail vehicle. The camera can periodically (or otherwise) capture images of the track that are analyzed for misalignment. If the track is misaligned, the track can cause derailment of the rail vehicle. Some of the systems and methods described herein detect track misalignment in advance (e.g., before the rail vehicle reaches the misaligned track) and prevent derailment by warning the operator of the rail vehicle. Optionally, in an unmanned rail vehicle (e.g., one that operates automatically), the systems and methods may automatically slow or stop movement of the rail vehicle in response to identifying misaligned tracks.

Additionally or alternatively, when the misaligned section of the track is identified, one or more other responsive actions may be initiated. For example, a warning signal may be communicated (e.g., transmitted or broadcast) to one or more other rail vehicles to warn the other vehicles of the misalignment, a warning signal may be communicated to one or more wayside devices disposed at or near the track so that the wayside devices can communicate the warning signals to one or more other rail vehicles systems, a warning signal can be communicated to an off-board facility that can arrange for the repair and/or further examination of the misaligned segment of the track, or the like.

The track may be misaligned when the track is not in the same location as a previous location due to shifting or movement of the track. For example, instead of breaks, corrosion, or the like, in the track, misalignment of the track can result from lateral movement of the track and/or vertical movement of the track from a previous position, such as the positions of the track when the track was installed or previously examined.

In contrast to systems and methods that involve the use of a device that generates light to inspect a route, such as a laser light source that generates laser light onto a rail of a track and monitors the laser light to identify changes in a profile of the rail, one or more aspects of the systems and methods described herein rely on acquisition of image data without generating light or other energy onto the route. As described below, one or more systems and methods described herein can take still pictures and/or video of a route and compare these pictures and/or video to baseline image data. No light such as laser light is used to mark or otherwise examine the route in at least one embodiment.

FIG. 1 is a schematic illustration of an optical route examination system 100 in accordance with one example of the inventive subject matter described herein. The system 100 is disposed onboard a vehicle 102, such as a rail vehicle. The vehicle 102 can be connected with one or more other vehicles, such as one or more locomotives and rail cars, to form a consist that travels along a route 120, such as a track. Alternatively, the vehicle 102 may be another type of vehicle, such as another type of off-highway vehicle (e.g., a vehicle that is not designed or is not permitted to travel on public roadways), an automobile, or the like. In a consist, the vehicle 102 can pull and/or push passengers and/or cargo, such as in a train or other system of vehicles.

The system 100 includes one or more cameras 106 (e.g., cameras 106*a*, 106*b*) mounted or otherwise connected with the vehicle 102 so that the cameras 106 move with the vehicle 102 along the route 120. The cameras 106 may be forward facing cameras 106 in that the cameras 106 are oriented toward a direction of travel or movement 104 of the vehicle 102. For example, fields of view 108, 110 of the cameras 106 represent the space that is captured on images obtained by the cameras 106. In the illustrated example, the cameras 106 are forward facing in that the fields of view 108, 110 capture images and/or video of the space in front of the moving vehicle 102. The cameras 106 can obtain static (e.g., still) images and/or moving images (e.g., video).

The cameras 106 may obtain the images of the route 120 while the vehicle 102 is moving at relatively fast speeds. For example, the images may be obtained while the vehicle 102 is moving at or near an upper speed limit of the route 120, such as the track speed of the route 120 when maintenance is not being performed on the route 120 or the upper speed limit of the route 120 has not been reduced.

The cameras 106 operate based on signals received from a camera controller 112. The camera controller 112 includes or represents one or more hardware circuits or circuitry that includes and/or is coupled with one or more computer processors (e.g., microprocessors) or other electronic logic-based devices. The camera controller 112 activates the cameras 106 to cause the cameras 106 to obtain image data. This image data represents images of the fields of view 108, 110 of the cameras 106, such as images of one or more portions or segments of the route 120 disposed ahead of the vehicle 102. The camera controller 112 can change the frame rate of the cameras 106 (e.g., the speed or frequency at which the cameras 106 obtain images).

One or more image analysis processors 116 of the system 100 examine the images obtained by one or more of the cameras 106. The processors 116 can include or represent one or more hardware circuits or circuitry that includes and/or is coupled with one or more computer processors (e.g., microprocessors) or other electronic logic-based devices. In one aspect, the processor 116 examines the images by identifying which portions of the images represent the route 120 and comparing these portions to one or more benchmark images. Based on similarities or differences between one or more camera-obtained images and the benchmark image(s), the processor 116 can determine if the segment of the route 120 that is shown in the camera images is misaligned.

Figure 2A:
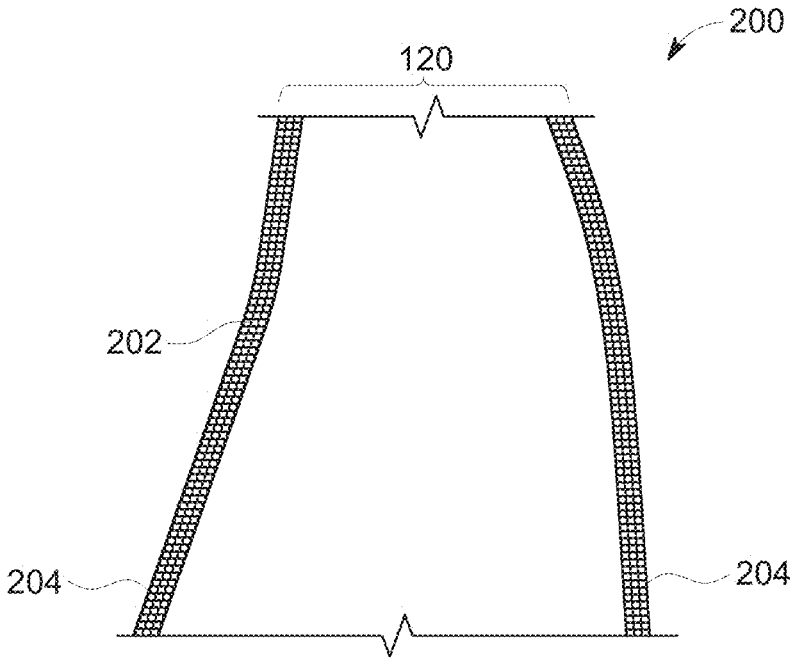
FIGS. 2A and 2B illustrate one example of a camera-obtained image of a segment of the route shown in FIG. 1.
Figure 2B:
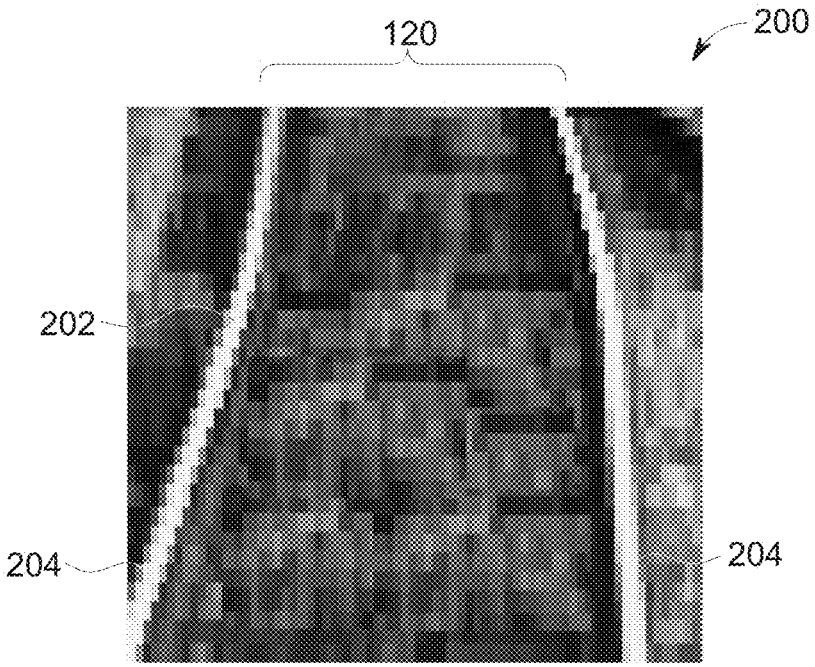

FIGS. 2A and 2B illustrate one example of a camera-obtained image 200 of a segment of the route 120. As shown in FIGS. 2A and 2B, the image 200 may be a digital image formed from several pixels 202 of varying color and/or intensity. Pixels 202 with greater intensities may be lighter in color (e.g., more white) while pixels 202 with lesser intensities may be darker in color. In one aspect, the image analysis processor 116 (shown in FIG. 1) examines the intensities of the pixels 202 to determine which portions of the image 200 represent the route 120 (e.g., rails 204 of the track). For example, the processor 116 may select those pixels 202 having intensities that are greater than a designated threshold, the pixels 202 having intensities that are greater than an average or median of several or all pixels 202 in the image 200, or other pixels 202 as representing locations of the route 120 (e.g., the rails 204 of a track). Alternatively, the processor 116 may use another technique to identify the rails 204 in the image 200.

Returning to the description of the system 100 shown in FIG. 1, the image analysis processor 116 can select one or more benchmark visual profiles from among several such profiles stored in a computer readable memory, such as an image memory 118. The memory 118 includes or represents one or more memory devices, such as a computer hard drive, a CD-ROM, DVD ROM, a removable flash memory card, a magnetic tape, or the like. The memory 118 can store the images 200 (shown in FIGS. 2A and 2B) obtained by the cameras 106 and the benchmark visual profiles associated with a trip of the vehicle 102.

The benchmark visual profiles represent designated layouts of the route 120 that the route 120 is to have at different locations. For example, the benchmark visual profiles can represent the positions, arrangements, relative locations, of rails of the route 120 when the rails were installed, repaired, last passed an inspection, or otherwise.

In one aspect, a benchmark visual profile is a designated gauge (e.g., distance between rails of a track) of the route 120. Alternatively, a benchmark visual profile can be a previous image of the route 120 at a selected location. In another example, a benchmark visual profile can be a definition of where the route 120 (e.g., the rails of a track) are expected to be located in an image of the route 120. For example, different benchmark visual profiles can represent different shapes of the rails 204 (shown in FIGS. 2A and 2B) of a track at different locations along a trip of the vehicle 102 from one location to another.

The processor 116 can determine which benchmark visual profile to select in the memory 118 based on a location of the vehicle 102 when the image 200 is obtained. A vehicle controller 114 is used to manually and/or autonomously control movement of the vehicle 102, and can track where the vehicle 102 is located when the images 200 are obtained. For example, the vehicle controller 114 can include and/or be connected with a positioning system, such as a global positioning system, cellular triangulation system, or the like, to determine where the vehicle 120 is located. Optionally, the vehicle controller 114 can determine where the vehicle 102 is located based on how fast the vehicle 102 is traveling and has traveled on the route 120, how long the vehicle 102 has been moving, and the known layout of the route 120. For example, the vehicle controller 114 can calculate how far the vehicle 102 has moved from a known location (e.g., a starting location or other location).

The processor 116 can select the benchmark visual profile from the memory 118 that is associated with and represents a designated layout or arrangement of the route 120 at the location of the vehicle 102 when the image 200 is obtained. This designated layout or arrangement can represent the shape, spacing, arrangement, or the like, that the route 120 is to have for safe travel of the vehicle 120. For example, the benchmark visual profile can represent the gauge and alignment of the rails 204 of the track when the track was installed or last inspected.

Figure 3A:
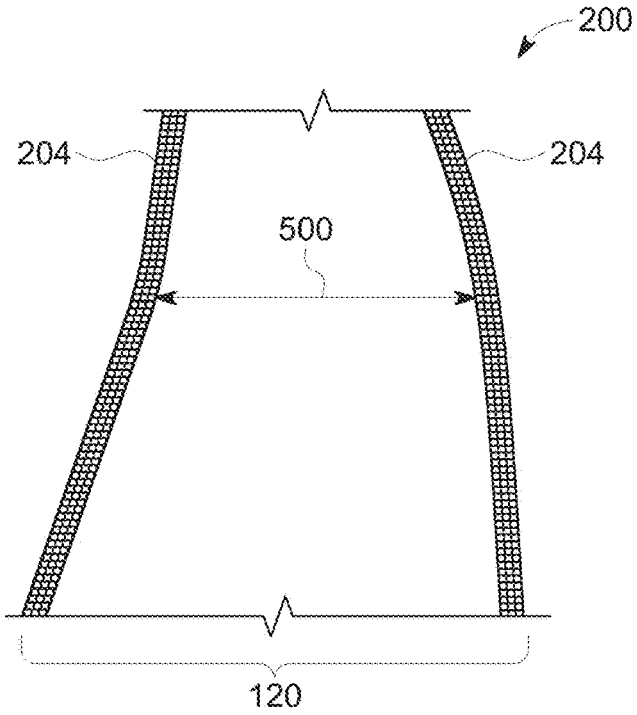
FIGS. 3A and 3B illustrate another example of the image of the route shown in FIG. 1.
Figure 3B:
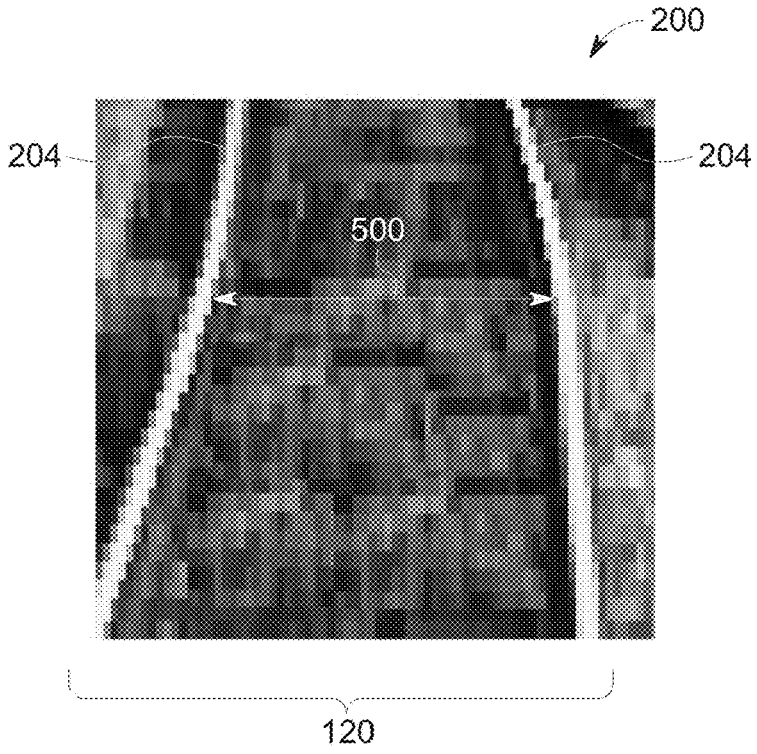

In one aspect, the image analysis processor 116 can measure a gauge of the segment of the route 120 shown in the image 200 to determine if the route 120 is misaligned. FIGS. 3A and 3B illustrate another example of the image 200 of the route 120 shown in FIG. 1. The image analysis processor 116 can examine the image 200 to measure a gauge distance 500 between the rails 204 of the route 120. In one aspect, the analysis processor 116 can measure a straight line or linear distance between one or more pixels 202 identified as representing one rail 204 to one or more other pixels 202 identified as representing another rail 204, as shown in FIGS. 3A and 3B. This distance represents the gauge distance 500 of the route 120. Alternatively, the distance between other pixels 202 may be measured. The processor 116 can determine the gauge distance 500 by multiplying the number of pixels 202 by a known distance that the width of each pixel 202 represents in the image 200, by converting the number of pixels 202 in the gauge distance 500 to length (e.g., in centimeters, meters, or the like) using a known conversion factor, by modifying a scale of the gauge distance 500 shown in the image 200 by a scaling factor, or otherwise.

The measured gauge distance 500 can be compared to a designated gauge distance stored in the memory 118 for the imaged section of the route 120 (or stored elsewhere). The designated gauge distance can be a benchmark visual profile of the route 120, as this distance represents a designated arrangement or spacing of the rails 204 of the route 120. If the measured gauge distance 500 differs from the designated gauge distance by more than a designated threshold or tolerance, then the processor 116 can determine that the segment of the route 120 that is shown in the image 200 is misaligned. For example, the designated gauge distance can represent the distance or gauge of the route 120 when the rails 204 were installed or last passed an inspection. If the measured gauge distance 500 deviates too much from this designated gauge distance, then this deviation can represent a changing or modified gauge distance of the route 120.

Optionally, the processor 116 may measure the gauge distance 500 several times as the vehicle 102 travels and monitor the measured gauge distances 500 for changes. If the gauge distances 500 change by more than a designated amount, then the processor 116 can identify the upcoming segment of the route 120 as being potentially misaligned. As described below, however, the change in the measured gauge distance 500 alternatively may represent a switch in the route 120 that the vehicle 102 is traveling toward.

Measuring the gauge distances 500 of the route 102 can allow the image analysis processor 116 to determine when one or more of the rails 204 in the route 120 are misaligned, even when the segment of the route 120 includes a curve. Because the gauge distance 500 should be constant or substantially constant (e.g., within manufacturing tolerances), the gauge distance 500 should not significantly change in curved or straight sections of the route 120, unless the route 120 is misaligned.

If the image analysis processor 116 determines from examination of one or more images 200 that the upcoming segment of the route 120 that the vehicle 102 is traveling toward is misaligned, the image analysis processor 116 can communicate a warning signal to the vehicle controller 114. This warning signal can indicate to the vehicle controller 114 that an upcoming segment of the route 120 is misaligned. In response to this warning signal, the vehicle controller 114 may take one or more responsive actions. For example, the vehicle controller 114 may include an output device, such as a display, speaker, or the like, that visually and/or audibly warns an operator of the vehicle 102 of the upcoming misaligned segment of the route 120. The operator may then decide how to proceed, such as by slowing or stopping movement of the vehicle, or by communicating with an off-board repair or inspection facility to request further inspection and/or maintenance of the misaligned segment of the route 120. Optionally, the vehicle controller 114 may automatically implement the responsive action, such as by automatically slowing or stopping movement of the vehicle 102 and/or automatically communicating with the off-board repair or inspection facility to request further inspection and/or maintenance of the misaligned segment of the route 120.

Figure 4:
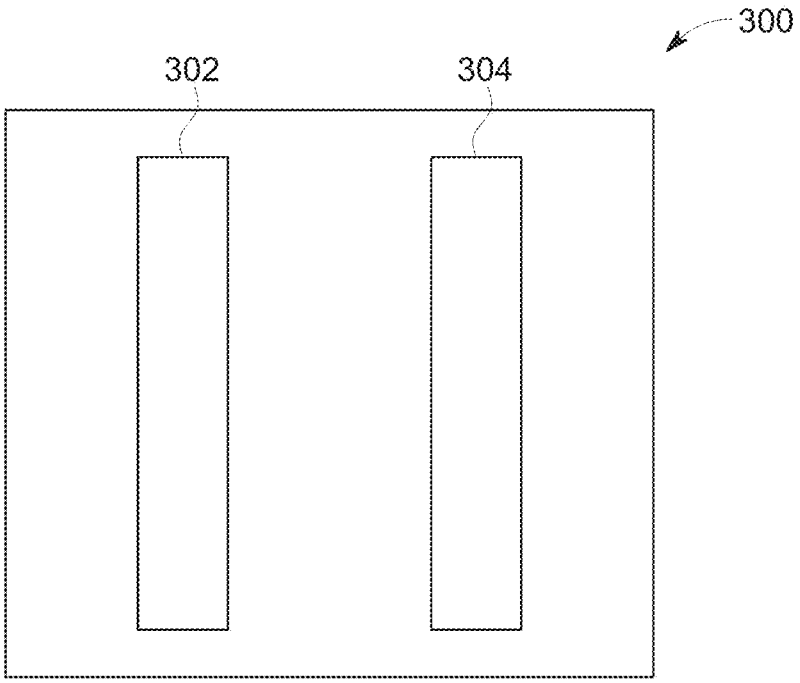
FIG. 4 illustrates another example of a benchmark visual profile.

FIG. 4 illustrates another example of a benchmark visual profile 300. The benchmark visual profile 300 represents a designated layout of the route 120 (shown in FIG. 1), such as where the route 120 is expected to be in the images obtained by one or more of the cameras 106 (shown in FIG. 1).

In the illustrated example, the benchmark visual profile 300 includes two designated areas 302, 304 that represent designated positions of rails of a track. The designated areas 302, 304 can represent where the pixels 202 (shown in FIGS. 2A and 2B) of the image 200 (shown in FIGS. 2A and 2B) that represent the rails 204 (shown in FIGS. 2A and 2B) should be located if the rails 204 are aligned properly. For example, the designated areas 302, 304 can represent expected locations of the rails 204 prior to obtaining the image 200. The rails 204 may be properly aligned when the rails 204 are in the same locations as when the rails 204 were installed or last passed an inspection of the locations of the rails 204, or at least within a designated tolerance. This designated tolerance can represent a range of locations that the rails 204 may appear in the image 200 due to rocking or other movements of the vehicle 102 (shown in FIG. 1).

Optionally, the benchmark visual profile 300 may represent a former image of the route 120 obtained by a camera 106 on the same or a different vehicle 102. The designated areas 302, 304 can represent the locations of the pixels 202 in the former image that have been identified as representing the route 120 (e.g., the rails 204).

In one aspect, the image analysis processor 116 can map the pixels 202 representative of the route 120 (e.g., the rails 204) to the benchmark visual profile 300 or can map the designated areas 302, 304 of the benchmark visual profile 300 to the pixels 202 representative of the route 120. This mapping may include determining if the locations of the pixels 202 representative of the route 120 (e.g., the rails 204) in the image 200 are in the same locations as the designated areas 302, 304 of the benchmark visual profile 300.

Figure 5A:
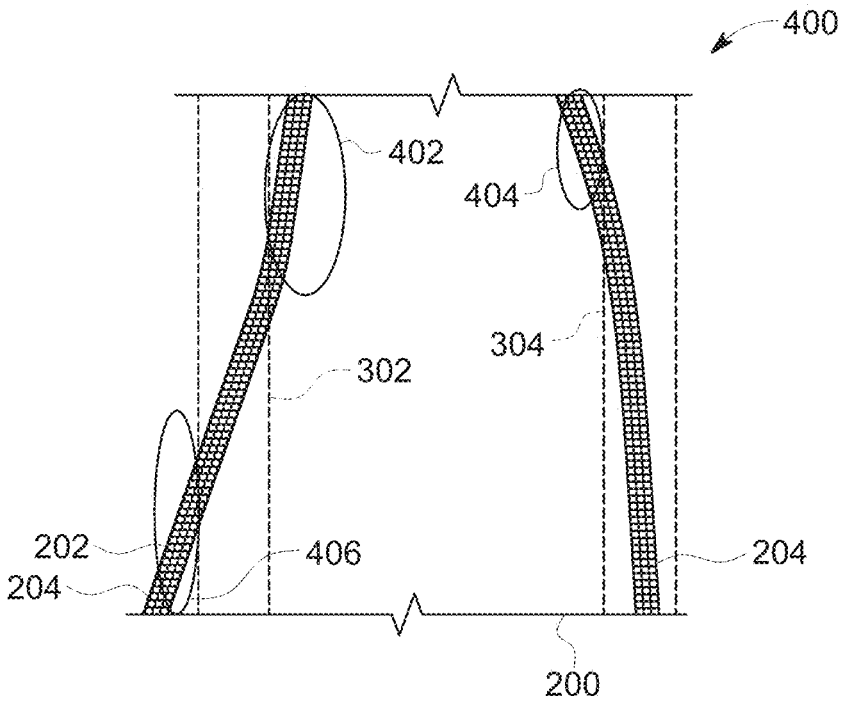
FIGS. 5A and 5B illustrate a visual mapping diagram of the image shown in FIGS. 2A and 2B and the benchmark visual profile shown in FIGS. 3A and 3B according to one example of the inventive subject matter described herein.
Figure 5B:
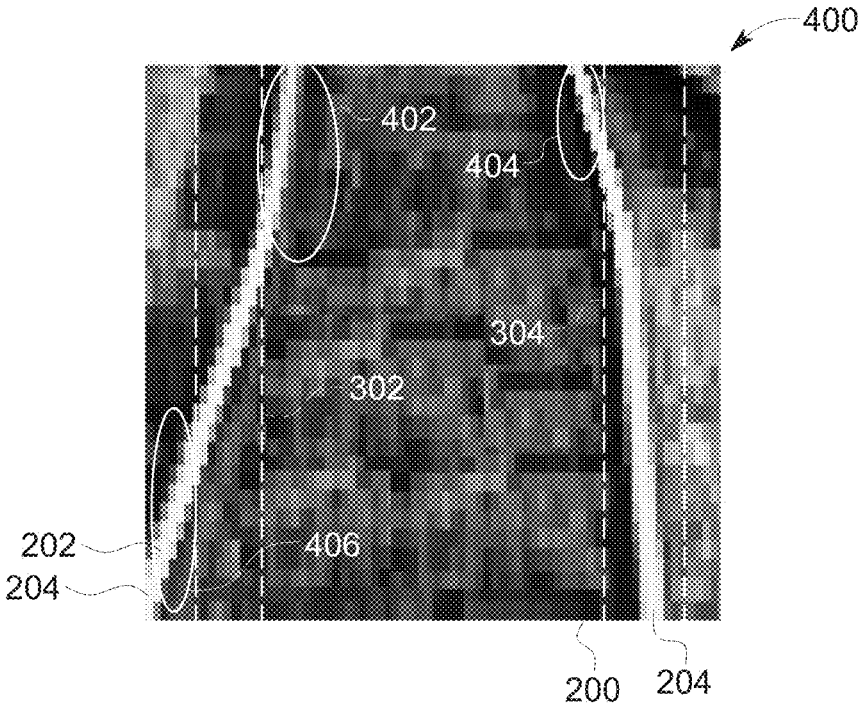

FIGS. 5A and 5B illustrate a visual mapping diagram 400 of the image 200 and the benchmark visual profile 300 according to one example of the inventive subject matter described herein. The mapping diagram 400 represents one example of a comparison of the image 200 with the benchmark visual profile 300 that is performed by the image analysis processor 116 (shown in FIG. 1). As shown in the mapping diagram 400, the designated areas 302, 304 of the benchmark visual profile 300 can be overlaid onto the image 200. The processor 116 can then identify differences between the image 200 and the benchmark visual profile 300. For example, the processor 116 can determine if the pixels 202 representing the route 120 (e.g., representing the rails 204) are disposed outside of the designated areas 302, 304. Optionally, the processor 116 can determine if locations of the pixels 202 representing the route 120 in the image 200 (e.g., coordinates of these pixels 202) are not located within the designated areas 302, 304 (e.g., are not coordinates located within outer boundaries of the designated areas 302, 304).

If the image analysis processor 116 determines that at least a designated amount of the pixels 202 representing the route 120 are outside of the designated areas 302, 304, then the processor 116 can identify the segment of the route 120 that is shown in the image 200 as being misaligned. For example, the processor 116 can identify groups 402, 404, 406 of the pixels 202 that represent the route 120 (e.g., the rails 204) as being outside of the designated areas 302, 304. If the number, fraction, percentage, or other measurement of the pixels 202 that are representative of the route 120 and that are outside the designated areas 302, 304 exceeds a designated threshold (e.g., 10%, 20%, 30%, or another amount), then the segment of the route 120 shown in the image 200 is identified as misaligned. On the other hand, if the number, fraction, percentage, or other measurement of the pixels 202 that are representative of the route 120 and that are outside the designated areas 302, 304 does not exceed the threshold, then the segment of the route 120 shown in the image 200 is not identified as misaligned.

During travel of the vehicle 102 over various segments of the route 120, the vehicle 102 may encounter (e.g., approach) an intersection between the segment of the route 120 being traveled upon and another route segment. In terms of rail vehicles, such an intersection can include a switch between two or more routes 120. Due to the arrangement of the rails 204 at a switch, the image analysis processor 116 may adapt the examination of the images 200 to determine if the rails 204 are misaligned.

Figure 6:
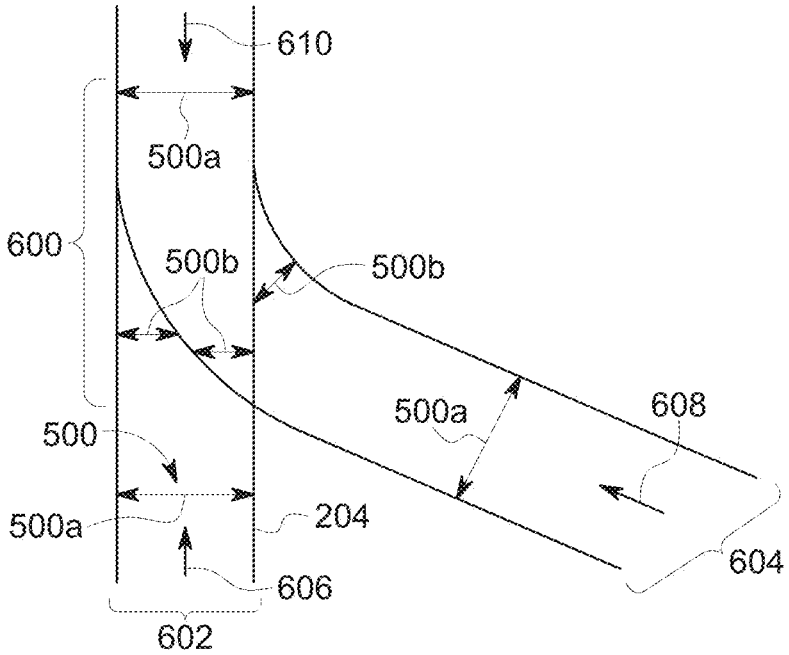
FIG. 6 is a schematic diagram of an intersection between two or more routes according to one example of the inventive subject matter described herein.

FIG. 6 is a schematic diagram of an intersection (e.g., switch) 600 between two or more routes 602, 604 according to one example of the inventive subject matter described herein. One or more, or each, of the routes 602, 604 may be the same as or similar to the route 120 shown in FIG. 1.

If the image analysis processor 116 is measuring gauge distances 500 (shown in FIGS. 3A and 3B) to determine if the rails 204 of the routes 602, 604 are misaligned, then the image analysis processor 116 may identify decreasing gauge distances 500 as the vehicle 102 approaches the switch 600. For example, if the vehicle 102 is traveling toward the switch 600 on the route 602 along a first direction of travel 606, or the vehicle 102 is traveling toward the switch 600 on the route 604 along a second direction of travel 608, or the vehicle 102 is traveling toward the switch 600 on the route 602 along a third direction of travel 610, then the image analysis processor 116 may determine that the measured gauge distances 500 are decreasing, such as from the distances 500*a* to the shorter distances 500*b*, or to another distance.

Without knowing that the vehicle 102 is approaching the switch 600, the image analysis processor 116 may incorrectly identify the rails 204 as being misaligned based on this decrease in the gauge distances 500 that are measured. In one aspect, however, the vehicle controller 114 may determine when the vehicle 102 is approaching the switch 600 (e.g., based on the location of the vehicle 102 as determined by the controller 114 and the known locations of the switch 600, such as from a map or track database that provides switch locations) and notify the image analysis processor 116. The image analysis processor 116 may then ignore the decreasing gauge distances 500 until the vehicle 102 has passed through or over the switch 600, such as by not implementing one or more responsive actions described above in response to the measured gauge distances 500 decreasing.

Alternatively, the image analysis processor 116 may obtain one or more benchmark visual profiles from the memory 118 (shown in FIG. 1) that represent the routes at or near the switch 600. Instead of representing parallel rails 204, these benchmark visual profiles can represent the arrangement of the rails 204 in the switch 600. The image analysis processor 116 may then compare the images of the route approaching the switch 600 to the benchmark visual profiles to determine if the route at or near the switch 600 is misaligned.

Optionally, the image analysis processor 116 may determine that the vehicle 102 is approaching the switch 600 based on the images obtained of the route approaching the switch 600. For example, the distances between the rails 204 of different routes 602, 604 approaching the switch 600 (e.g., the gauge distances 500*b*) may be stored in the memory 118 as benchmark visual profiles. When the image analysis processor 116 determines that the gauge distances 500 being measured from the images of the route 602 or 604 are the same or similar to the stored gauge distances, then the image analysis processor 116 may determine that the vehicle 102 is approaching the switch 600. The image analysis processor 116 may be used to determine when the vehicle 102 approaches a switch 600 in order to confirm a location of the vehicle 102 as determined by the vehicle controller 114, to assist in locating the vehicle 102 when the controller 114 cannot determine the location of the vehicle 102, and so on.

In one aspect, the image analysis processor 116 may create a benchmark visual profile from the image data that is obtained from the camera. For example, the image analysis processor 116 may not have access to a benchmark visual profile, the section of the route being examined may not be associated with a benchmark visual profile, or the like. The image analysis processor 116 can use the image data to create a benchmark visual profile "on-the-fly," such as by creating the benchmark visual profile as the image data is obtained. The benchmark visual profile can then be used to examine the image data from which the benchmark visual profile was created to identify problems with the route.

Figure 10:
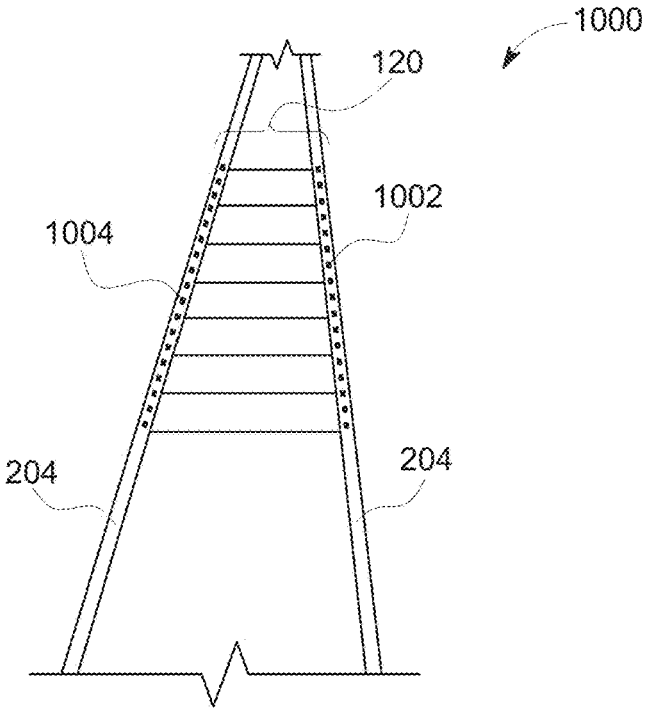
FIG. 10 illustrates a camera-obtained image with benchmark visual profiles of the route according to another example of the inventive subject matter described herein.

FIG. 10 illustrates a camera-obtained image 1000 with benchmark visual profiles 1002, 1004 of the route 120 according to another example of the inventive subject matter described herein. The benchmark visual profiles 1002, 1004 are created by the image analysis processor 116 (shown in FIG. 1) from the image data used to create the image 1000. For example, the image analysis processor 116 can examine intensities of the pixels to determine the location of the route 120, as described above. Within the location of the route 120, the image analysis processor 116 can find two or more pixels having the same or similar (e.g., within a designated range of each other) intensities. Optionally, the image analysis processor 116 may identify many more pixels with the same or similar intensities.

The image analysis processor 116 then determines a relationship between these pixels. For example, the image analysis processor 116 may identify a line between the pixels in the image 1000 for each rail 204. These lines represent the benchmark visual profiles 1002, 1004. The image analysis processor 116 can then determine if other pixels representative of the rails 204 of the route 120 are on or within the benchmark visual profiles 1002, 1004 (e.g., within a designated distance of the benchmark visual profiles 1002, 1004, or if these pixels are outside of the benchmark visual profiles 1002, 1004. In the illustrated example, most or all of the pixels representative of the rails 204 of the route 120 are on or within the benchmark visual profiles 1002, 1004.

Figure 11:
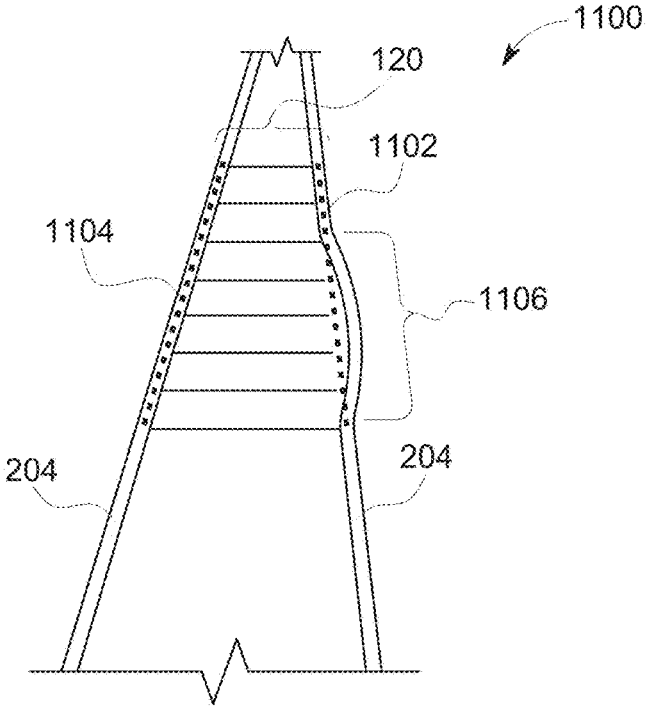
FIG. 11 illustrates another camera-obtained image with benchmark visual profiles of the route according to another example of the inventive subject matter described herein.

FIG. 11 illustrates another camera-obtained image 1100 with benchmark visual profiles 1102, 1104 of the route 120 according to another example of the inventive subject matter described herein. The benchmark visual profiles 1102, 1104 may be created using the image data used to form the image 1100, as described above in connection with FIG. 10. In contrast to the image 1000 shown in FIG. 10, however, a segment 1106 of the route 120 does not fall on or within the benchmark visual profile 1104. This segment 1106 curves outward and away from the benchmark visual profile 1104. The image analysis processor 116 can identify this segment 1106 because the pixels having intensities that represent the rail 204 are no longer on or in the benchmark visual profile 1104. Therefore, the image analysis processor 116 can identify the segment 1106 as a misaligned segment of the route 120.

In one aspect, the image analysis processor 116 can use a combination of techniques described herein for examining the route. For example, if both rails 202, 204 of a route 120 are bent or misaligned from previous positions, but are still parallel or substantially parallel to each other, then the gauge distance between the rails 202, 204 may remain the same or substantially the same, and/or may not substantially differ from the designated gauge distance 500 of the route 120. As a result, only looking at the gauge distance in the image data may result in the image analysis processor 116 failing to identify damage (e.g., bending) to the rails 202, 204. In order to avoid this situation, the image analysis processor 116 additionally can generate the benchmark visual profiles 1102, 1104 using the image data and compare these profiles to the image data of the rails, as described above in connection with FIGS. 10 and 11. Bending or other misalignment of the rails 202, 204 may then be identified when the bending in the rails 202, 204 deviates from the benchmark visual profile created from the image data.

Figure 7:
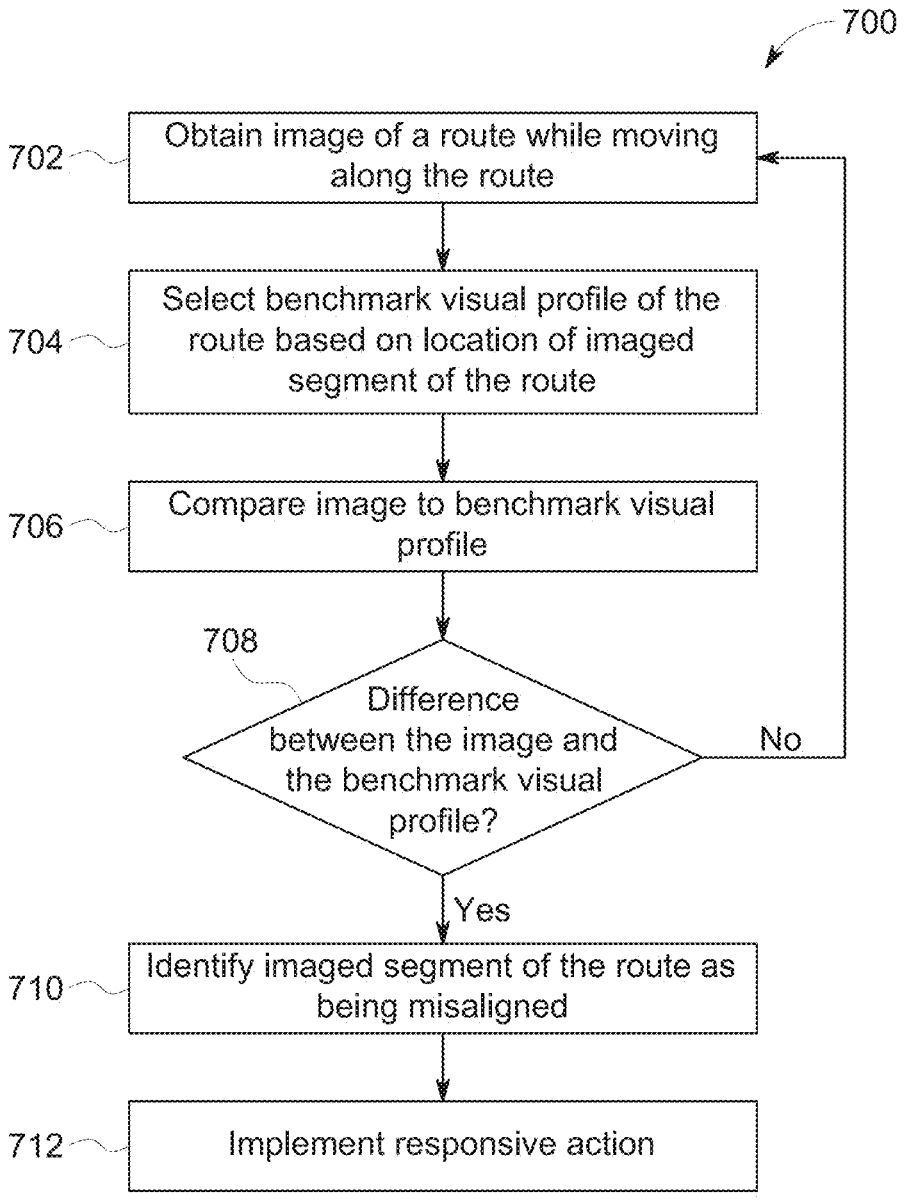
FIG. 7 illustrates a flowchart of a method for examining a route from a vehicle as the vehicle is moving along the route.

FIG. 7 illustrates a flowchart of a method 700 for examining a route from a vehicle as the vehicle is moving along the route. The method 700 can be performed by one or more embodiments of the route examining system 100 (shown in FIG. 1). At 702, an image of the route is obtained from one or more cameras of the vehicle. The image can be obtained of a segment of the route that is ahead of the vehicle along a direction of travel of the vehicle (e.g., the vehicle is moving toward the segment being imaged).

At 704, a benchmark visual profile of the route is selected based on the location of the segment of the route that was imaged. As described above, the benchmark visual profile can represent a designated gauge distance of the route, a previous image of the route, a spatial representation of where the route is expected to be located or previously was located, or the like.

At 706, the image is compared to the benchmark visual profile. For example, the gauge of the rail in an image of the route may be measured and compared to the designated gauge of the benchmark visual profile. Optionally, the location of rails in the image may be determined and compared to locations of rails in a previous image of the route. In one aspect, the location of rails in the image are determined and compared to designated areas of the benchmark visual profile.

At 708, a determination is made as to whether there are differences between the image of the route and the benchmark visual image. For example, a determination may be made as to whether the gauge distance measured from the image is different from the designated gauge distance of the benchmark visual profile. Additionally or alternatively, a determination may be made as to whether the locations of the rails in the image are different from the locations of the rail in a previous image of the route. Optionally, a determination may be made as to whether the locations of the rails in the image are outside of designated areas in the benchmark visual profile. If one or more of these differences are identified, then the difference may indicate that the route (e.g., one or more of the rails) has become misaligned, such as by bending, moving relative to the ground or underlying ballast material, breaking, or the like.

If one or more differences between the image and the benchmark visual profile are identified, then the route may be misaligned from a previous or designated position. As a result, flow of the method 700 can proceed to 710. On the other hand, if no differences are identified, or if the differences are relatively small or minor, then the route may still be in the same alignment as a previous or designated position (or has moved a relatively small amount). As a result, the vehicle can continue traveling along the upcoming segment of the route, and the method 700 can return to 702.

At 710, the segment of the route in the image is identified as being misaligned. At 712, one or more responsive actions may be implemented, such as by communicating a warning signal to one or more other rail vehicles to warn the other vehicles of the misalignment, communicating a warning signal to one or more wayside devices disposed at or near the track so that the wayside devices can communicate the warning signals to one or more other rail vehicles systems, communicating a warning signal to an off-board facility, automatically slowing or stopping movement of the vehicle, notifying an onboard operator of the misalignment, or the like. Depending on whether the vehicle can continue moving along the route, flow of the method 700 may return to 702.

In another aspect of the inventive subject matter described herein, the optical route examining system and method may use plural cameras mounted in front of the vehicle and oriented toward (e.g., facing) the route being traveled on. The cameras capture images at a relatively high (e.g., fast) frame rate so as to give a static, stable image of the route. Using plural acquired images, the images are analyzed so that obstacles (e.g., pedestrians, cars, trees, and the like) are identified and/or highlighted. The system and method can warn or provide an indication to the operator of the vehicle of the obstacle to trigger a braking action (manually or autonomously). In the event that the operator does not take action to slow down or apply the brakes of the vehicle, then the brakes may be automatically applied without operator intervention.

The cameras can capture the images at a relatively high frame rate (e.g., at a relatively fast frequency) so as to give static, stable images of the upcoming portion of the route being traveled upon. There may be a temporal delay or lag (e.g., of a few milliseconds) between the capture times for the images obtained by the different cameras. In one aspect, the images captured from different cameras in same time frame (e.g., within the same relatively short time frame) are compared to identify foreign objects on or near the upcoming segment of the route. Feature detection algorithms can be used to identify significant features on the images, such as people, birds, cars, other vehicles (e.g., locomotives), and the like. In one aspect, the images are analyzed to identify a depth of a foreign object, which can be used to estimate a size of the foreign object and/or to identify the foreign object. Using a difference technique, non-stable obstacles like snow, rain, pebbles, and the like, can be eliminated or ignored. Major obstacles such as cars, pedestrians on the track, and the like, can be identified or highlighted, and used to alert the operator of the vehicle of the presence of the major obstacle.

Currently, train operators may not receive sufficiently early warnings or identifications of obstacles on an upcoming segment of the track in different weather conditions. Even the operators are able to see the obstacle, the obstacle may not be seen in time to allow the operator to apply the brakes and stop the train (or other vehicle) before collision with the obstacle. If the advanced image capture and analysis techniques descried herein can detect far-away obstacles early enough, collisions with the obstacles can be avoided.

Returning to the description of the route examining system 100 shown in FIG. 1, one or more of the cameras 106 can obtain several images 200 of an upcoming segment of the route 120 during movement of the vehicle 102 along the route 120. The description below focuses on two or more cameras 106 obtaining the images 200, but optionally, only one of the cameras 106 may obtain the images 200. The image analysis processor 116 may control the cameras 106 to acquire the images 200 at relatively fast frame rates, such as at least by obtaining 300 images per second per camera, 120 images per second per camera, 72 images per second per camera, 48 images per second per camera, 24 images per second per camera, or another rate.

The image analysis processor 116 then compares the images obtained by one or more of the cameras 106 to identify differences in the images. These differences can represent transitory foreign objects or persistent foreign objects on or near the segment of the route 120 that the vehicle 102 is traveling toward. A transitory foreign object is an object that is moving sufficiently fast that the object will not interfere or collide with the vehicle 102 when the vehicle 102 reaches the foreign object. A persistent foreign object is an object that is stationary or moving sufficiently slow that the vehicle 102 will collide with the foreign object when the vehicle 102 reaches the foreign object.

Figure 8:
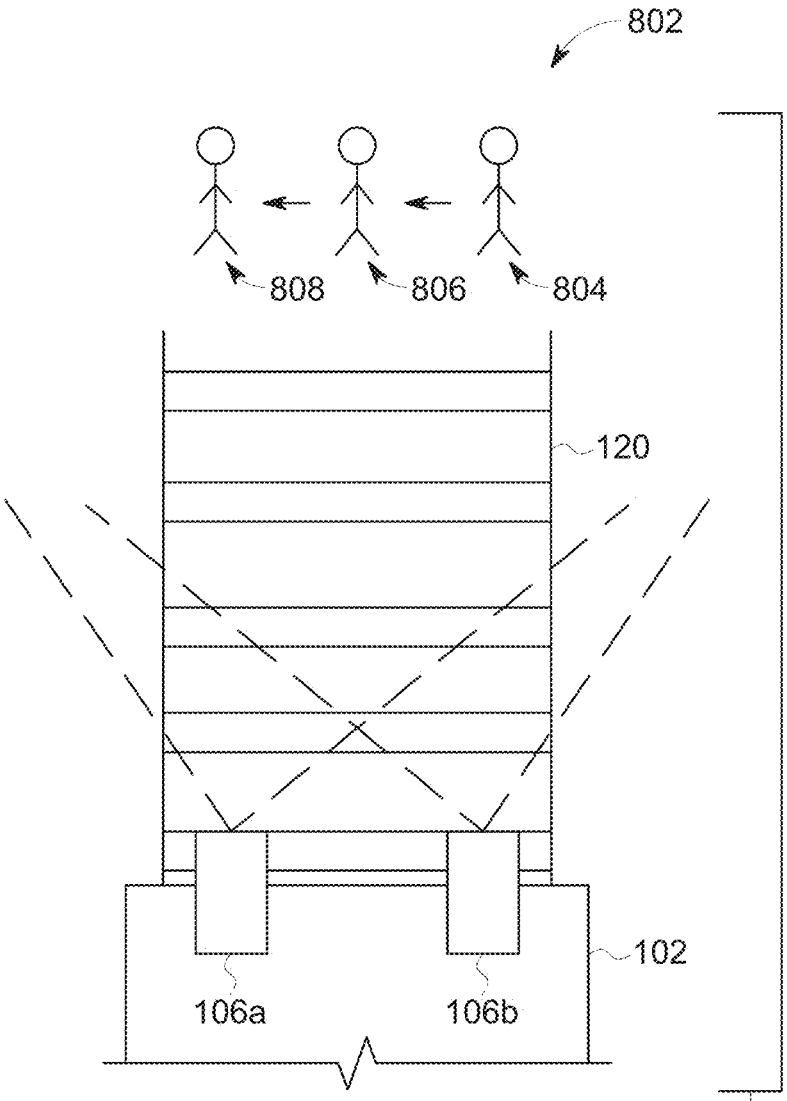
FIG. 8 is an overlay representation of three images acquired by one or more of the cameras shown in FIG. 1 and overlaid on each other according to one example of the inventive subject matter described herein.

FIG. 8 is an overlay representation 800 of three images acquired by one or more of the cameras 106 and overlaid on each other according to one example of the inventive subject matter described herein. The overlay representation 800 represents three images of the same segment of the route 120 taken at different times by one or more of the cameras 106 and combined with each other. The image analysis processor 116 may or may not generate such an overlay representation when examining the images for a foreign object.

As shown in the representation 800, the route 120 is a persistent object in that the route 120 remains in the same or substantially same location in the images obtained at different times. This is because the route 120 is not moving laterally relative to the direction of travel of the vehicle 102 (shown in FIG. 1) as the vehicle 102 travels along the route 120. The image analysis processor 116 can identify the route 120 by examining intensities of pixels in the images, as described above, or using another technique.

Also as shown in the representation 800, a foreign object 802 appears in the images. The image analysis processor 116 can identify the foreign object 802 by examining intensities of the pixels in the images (or using another technique) and determining that one or more groups of pixels having the same or similar (e.g., within a designated range) of intensities appear in locations of the images that are close to each other. Optionally, the image analysis processor 116 can compare one or more of the images acquired by the one or more cameras 106 and compare the images to one or more benchmark visual profile, similar to as described above. If differences between the images and the benchmark visual images are identified, then the image analysis processor 116 may identify these differences as being representative of the foreign object 802. For example, if a benchmark visual profile represents only the rails 204, but the rails 204 and another object appear in an image, then the image analysis processor 116 can identify the other object as the foreign object 802. In one aspect, the image analysis processor 116 is able to distinguish between the route 120 (e.g., the rails 204) and the foreign object 802 due to the different shapes and/or sizes of the route 120 and the foreign object 802.

Once the foreign object 802 is identified, the image analysis processor 116 can direct one or more of the cameras 106 to zoom in on the foreign object 802 and obtain one or more magnified images. For example, the initial identification of the foreign object 802 may be confirmed by the image analysis processor 116 directing the cameras 106 to magnify the field of view of the cameras 106 and to acquire magnified images of the foreign object 802. The image analysis processor 116 may again examine the magnified images to confirm the presence of the foreign object 802, or to determine that no foreign object 802 is present.

The image analysis processor 116 may examine a sequence of two or more of the images (e.g., magnified images or images acquired prior to magnification) to determine if the foreign object 802 is a persistent object or a transitory object. In one aspect, if the foreign object 802 appears in and is identified by the processor 116 in at least a designated number of images within a designated time period, then the foreign object 802 is identified by the processor 116 as a persistent object. The appearance of the foreign object 802 in the designated number of images (or a greater amount of images) for at least the designated time period indicates that the foreign object 802 is located on or near the upcoming segment of the route 120, and/or likely will remain on or near the route 120.

For example, a bird flying over the route 120, precipitation falling onto the route 120, and the like, may appear in one or more of the images acquired by the cameras 106. Because these foreign objects 802 tend to move fairly fast, these foreign objects 802 are less likely to be present in the images for more than the designated number of images during the designated period of time. As a result, the image analysis processor 116 does not identify these types of foreign objects 802 as persistent objects, and instead ignores these foreign objects or identifies the foreign objects as transient objects.

As another example, a person standing or walking over the route 120, a car parked or slowly moving over the route 120, and the like, may appear in images acquired by the cameras 106 over a longer period of time than flying birds or falling precipitation. As a result, the person or car may appear in at least the designated number of images for at least the designated time period. The image analysis processor 116 identifies such foreign objects as persistent objects.

In response to identifying a foreign object as a persistent object, the image analysis processor 116 may implement one or more mitigating actions. For example, the image analysis processor 116 can generate a warning signal that is communicated to the vehicle controller 114 (shown in FIG. 1). This warning signal may cause one or more alarms to sound, such as an internal and/or external siren to generate an audible warning or alarm that the vehicle 102 is approaching the persistent object. Optionally, the warning signal may generate a visual or other alarm to an operator of the vehicle 102 to notify the operator of the persistent object. Additionally or alternatively, the warning signal may cause the vehicle controller 114 to automatically apply brakes of the vehicle 102. In one aspect, the warning signal may cause the vehicle controller 114 to communicate a signal to a switch or other wayside device that controls a switch, so that the switch is automatically changed to cause the vehicle 102 to leave the currently traveled route 102 (on which the persistent object is detected) and to move onto another, different route to avoid colliding with the persistent object.

In one example of the inventive subject matter described herein, the image analysis processor 116 can determine a moving speed of the persistent object and determine which mitigating action, if any, to implement. In the example shown in FIG. 8, the foreign object 802 appears in different locations of the images relative to the route 120. For example, in a first image, the foreign object 802 appears at a first location 804, in a subsequent, second image, the foreign object 802 appears at a different, second location 806, and in a subsequent, third image, the foreign object 802 appears at a different, third location 808.

The image analysis processor 116 can identify the changing positions of the foreign object 802 and estimate a moving speed of the foreign object 802. For example, the image analysis processor 116 can control the frame rate of the cameras 106, and therefore can know the length of time between when consecutive images were acquired. The image analysis processor 116 can measure the changes in positions of the foreign object 802 between the different locations 804, 806, 808, and so on, and scale these changes in positions to an estimated distance that the foreign object 802 has moved between the images. For example, the image analysis processor 116 can estimate the distance in a manner similar to measuring the gauge distance 500 shown in FIGS. 3A and 3B. Instead of measuring the distance between rails 204, however, the image analysis processor 116 is estimating the movement distance of the foreign object 802.

The image analysis processor 116 can estimate the moving speed at which the foreign object 802 is moving using the changes in positions divided by the time period between when the images showing the different positions of the foreign object 802 were acquired. If the foreign object 802 is moving slower than a designated speed, then the image analysis processor 116 may determine that the foreign object 802 is unlikely to clear the route 120 before the vehicle 102 reaches the foreign object 802. As a result, the image analysis processor 116 may generate a warning signal for the vehicle controller 114 that requests a more immediate response, such as by immediately actuating the brakes of the vehicle 102 (e.g., to a full or sufficiently large extent to slow and stop movement of the vehicle 102). If the foreign object 802 is moving at least as fast as the designated speed, then the image analysis processor 116 may determine that the foreign object 802 is more likely to clear the route 120 before the vehicle 102 reaches the foreign object 802. As a result, the image analysis processor 116 may generate a warning signal for the vehicle controller 114 that requests a less immediate response, such as by activating a warning siren, automatically reducing the throttle level, and/or automatically slowing (but not stopping) the vehicle 102 by applying the brakes.

In one embodiment, the image analysis processor 116 can use images obtained by two or more cameras 106 to confirm or refute the potential identification of a persistent object on or near the route 120. For example, the processor 116 can examine a first set of images from one camera 106*a* and examine a second set of images from another camera 106*b* to determine if the persistent object is identified in both the first set of images and the second set of images. If the persistent object is detected from both sets of images, then the image analysis processor 116 may determine which mitigating action to implement, as described above.

The image analysis processor 116 can examine the images obtained by the two or more cameras 106 to estimate a depth of the foreign object 802. For example, the images acquired at the same time or approximately the same time by different, spaced apart cameras 106 may provide a stereoscopic view of the foreign object 802. Due to the slightly different fields of view of the cameras 106, the images that are obtained at the same time or nearly the same time may have slight differences in the relative location of the foreign object 802, even if the foreign object 802 is stationary. For example, the foreign object 802 may appear slightly to one side of the image acquired by one camera 106*a* than in the image acquired by another camera 106*b*. The image analysis processor 116 can measure these differences (e.g., by measuring the distances between common pixels or portions of the foreign object 802) and estimate a depth of the foreign object 802 (e.g., the distance between opposite sides of the foreign object 802 along a direction that is parallel or coaxial with the direction of travel of the vehicle 102). For example, larger depths may be estimated when these differences are larger than when the differences are smaller.

The image analysis processor 116 may use the estimated depth to determine which mitigating action to implement. For example, for larger estimated depths, the image analysis processor 116 may determine that the foreign object 802 is larger in size than for smaller estimated depths. The image analysis processor 116 may request more severe mitigating actions for larger estimated depths and less severe mitigating actions for smaller estimated depths.

Additionally or alternatively, the image analysis processor 116 may examine the two dimensional size of an identified foreign object 802 in one or more of the images to determine which mitigating action to implement. For example, the image analysis processor 116 can measure the surface area of an image that represents the foreign object 802 in the image. The image analysis processor 116 can combine this two dimensional size of the foreign object 802 in the image with the estimated depth of the foreign object 802 to determine a size index of the foreign object 802. The size index represents how large the foreign object 802 is. Optionally, the size index may be based on the two dimensional size of the imaged foreign object 802, and not the estimated depth of the foreign object 802.

The image analysis processor 116 may use the size index to determine which mitigating action to implement. The image analysis processor 116 may request more severe mitigating actions for larger size indices and less severe mitigating actions for smaller size indices.

The image analysis processor 116 can compare the two dimensional areas and/or estimated depths of the foreign object 802 to one or more object templates to identify the foreign object 802. The object templates may be similar to the designated areas 302, 304 shown in the benchmark visual image 300 in FIGS. 5A and 5B. As described above, the designated areas 302, 304 represent where properly aligned rails 204 are expected to be located in an image. Similar designated areas can represent shapes of other objects, such as pedestrians, automobiles, livestock, or the like. The image analysis processor 116 can compare the size and/or shape of the foreign object 802 in one or more images with the size and/or shape of one or more designated areas (e.g., object templates) that represent one or more different foreign objects. If the size and/or shape of the foreign object 802 is the same as or similar to (e.g., within a designated tolerance), then the image analysis processor 116 can identify the foreign object 802 in the image as the same foreign object represented by the object template.

The image analysis processor 116 may use the identification of the foreign object 802 to determine which mitigating action to implement. For example, if the foreign object 802 is identified as an automobile or pedestrian, the image analysis processor 116 may request more severe mitigating actions than if the foreign object 802 is identified as something else, such as livestock.

In one aspect, the image analysis processor 116 stores one or more of the images in the memory 118 and/or communicates the images to an off-board location. The images may be retrieved from the memory 118 and/or from the off-board location, and compared with one or more images of the same segments of the route 120 obtained by the same vehicle 102 at a different time and/or by one or more other vehicles 102 at other times. Changes in the images of the route 120 may be used to identify degradation of the route 102, such as by identifying wear and tear in the route 120, washing away of ballast material beneath the route 120, or the like, from changes in the route 120 over time, as identified in the images.

Figure 9:
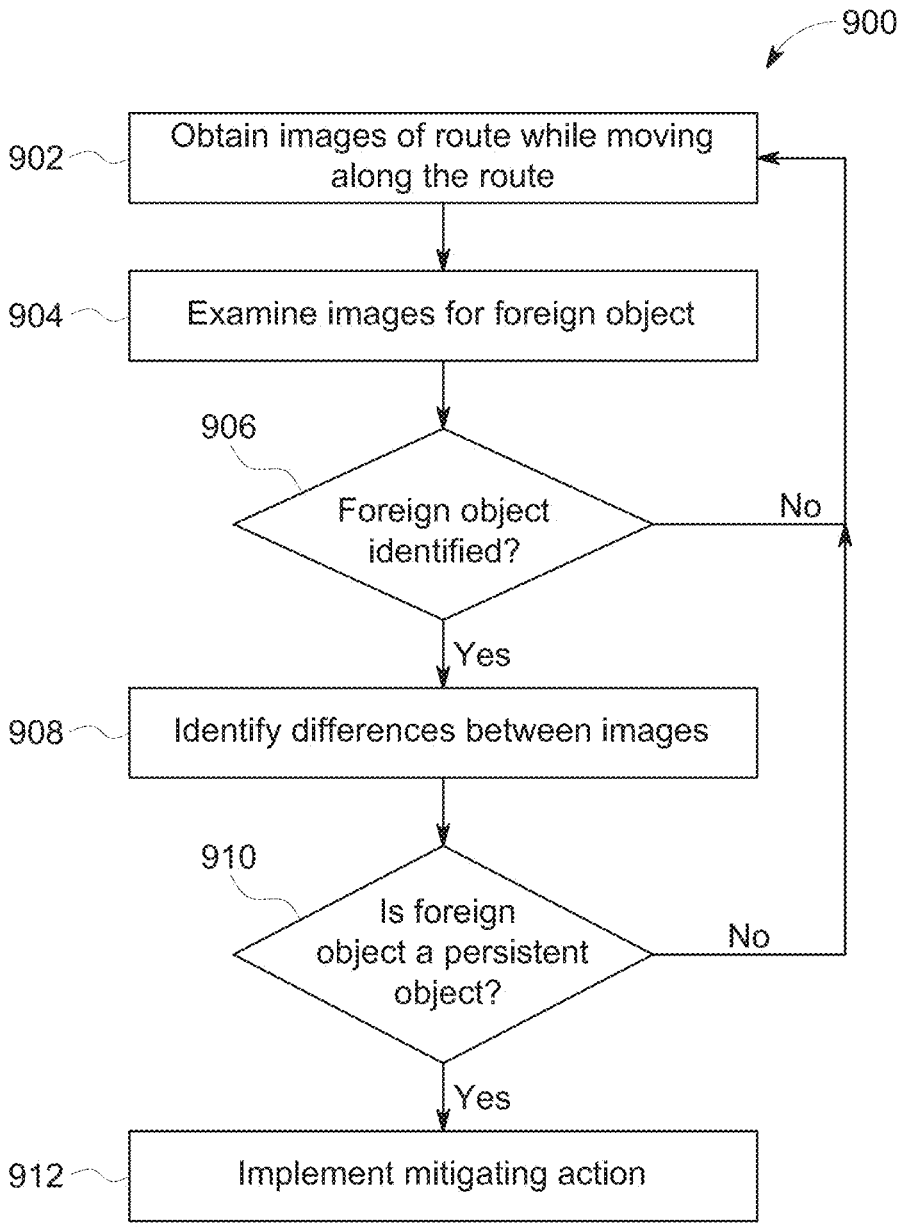
FIG. 9 illustrates a flowchart of a method for examining a route from a vehicle as the vehicle is moving along the route.

FIG. 9 illustrates a flowchart of a method 900 for examining a route from a vehicle as the vehicle is moving along the route. The method 900 can be performed by one or more embodiments of the route examining system 100 (shown in FIG. 1). At 902, plural images of the route are obtained from one or more cameras of the vehicle. The images can be obtained of a segment of the route that is ahead of the vehicle along a direction of travel of the vehicle (e.g., the vehicle is moving toward the segment being imaged).

At 904, the images are examined to determine if a foreign object is present in one or more of the images. For example, intensities of the pixels in the images can be examined to determine if a foreign object is on or near the segment of the route being approached by the vehicle.

At 906, a determination is made as to whether a foreign object is identified in the image. For example, if the image is compared to a previous image or other benchmark visual profile, and the shape of an object appears in the current image, but not the previous image or the other benchmark visual profile, then the object may represent a foreign object. As a result, the foreign object is identified in the image, and flow of the method 900 can proceed to 908. On the other hand, if no foreign object is identified in the image, then flow of the method 900 can return to 902.

In one aspect, the presence of the foreign object may be determined by examining a first set of images acquired by a first camera and a second set of images acquired by a second camera. If the foreign object is identified in the first set of images and the foreign object is identified in the second set of images, then flow of the method 900 can proceed to 908. Otherwise, flow of the method 900 can return to 902.

In one aspect, the presence of the foreign object may be determined by examining different images acquired at different magnification levels. For example, if the foreign object is identified in one or more images obtained at a first magnification level, the camera may zoom into the foreign object and acquire one or more images at an increased second magnification level. The images at the increased magnification level can be examined to determine if the foreign object appears in the images. If the foreign object is identified in the magnified second, then flow of the method 900 can proceed to 908. Otherwise, flow of the method 900 can return to 902.

At 910, a determination is made as to whether the foreign object is a persistent object or a transitory object. As described above, a sequential series of two or more images of the route can be examined to determine if the foreign object is present in the images. If the foreign object does appear in at least a designated number of the images for at least a designated time period, then the foreign object may be identified as a persistent object, as described above. As a result, one or more mitigating actions may need to be taken to avoid colliding with the foreign object, and flow of the method 900 can proceed to 912.

On the other hand, if the foreign object does not appear in at least the designated number of the images for at least the designated time period, then the foreign object may be a transitory object, and may not be identified as a persistent object, as described above. As a result, one or more mitigating actions may not need to be taken as the foreign object may not be present when the vehicle reaches the location of the foreign object. Flow of the method 900 can then return to 902.

At 912, one or more mitigating actions may be taken. For example, the operator of the vehicle may be warned of the presence of the foreign object, an audible and/or visual alarm may be activated, the brakes of the vehicle may be automatically engaged, the throttle of the vehicle may be reduced, or the like. As described above, the size, depth, and/or identity of the foreign object may be determined and used to select which of the mitigating actions is implemented.

In one example of the inventive subject matter described herein, a method (e.g., for optically examining a route such as a track) includes obtaining one or more images of a segment of a track from a camera mounted to a rail vehicle while the rail vehicle is moving along the track and selecting (with one or more computer processors) a benchmark visual profile of the segment of the track. The benchmark visual profile represents a designated layout of the track. The method also can include comparing (with the one or more computer processors) the one or more images of the segment of the track with the benchmark visual profile of the track and identifying (with the one or more computer processors) one or more differences between the one or more images and the benchmark visual profile as a misaligned segment of the track.

In one aspect, the one or more images of the segment of the track are compared to the benchmark visual profile by mapping pixels of the one or more images to corresponding locations of the benchmark visual profile and determining if the pixels of the one or more images that represent the track are located in common locations as the track in the benchmark visual profile.

In one aspect, the method also includes identifying portions of the one or more images that represent the track by measuring intensities of pixels in the one or more images and distinguishing the portions of the one or more images that represent the track from other portions of the one or more images based on the intensities of the pixels.

In one aspect, the benchmark visual profile visually represents locations where the track is located prior to obtaining the one or more images.

In one aspect, the method also includes measuring a distance between rails of the track by determining a number of pixels disposed between the rails in the one or more images.

In one aspect, the method also includes comparing the distance with a designated distance to identify a changing gauge of the segment of the track.

In one aspect, the method also includes identifying a switch in the segment of the track by identifying a change in the number of pixels disposed between the rails in the one or more images.

In one aspect, the method also includes creating the benchmark visual profile from at least one image of the one or more images that are compared to the benchmark visual profile to identify the one or more differences.

In one aspect, the method also includes comparing the one or more images of the segment of the track with one or more additional images of the segment of the track obtained by one or more other rail vehicles at one or more other times in order to identify degradation of the segment of the track.

In one aspect, the one or more images of the segment of the track are obtained while the rail vehicle is traveling at an upper speed limit of the segment of the track (e.g., track speed).

In another example of the inventive subject matter described herein, a system (e.g., an optical route examining system) includes a camera and one or more computer processors. The camera is configured to be mounted to a rail vehicle and to obtain one or more images of a segment of a track while the rail vehicle is moving along the track. The one or more computer processors are configured to select a benchmark visual profile of the segment of the track that represents a designated layout of the track. The one or more computer processors also are configured to compare the one or more images of the segment of the track with the benchmark visual profile of the track to identify one or more differences between the one or more images and the benchmark visual profile as a misaligned segment of the track.

In one aspect, the one or more computer processors are configured to compare the one or more images of the segment of the track to the benchmark visual profile by mapping pixels of the one or more images to corresponding locations of the benchmark visual profile and determining if the pixels of the one or more images that represent the track are located in common locations as the track in the benchmark visual profile.

In one aspect, the one or more computer processors are configured to identify portions of the one or more images that represent the track by measuring intensities of pixels in the one or more images and to distinguish the portions of the one or more images that represent the track from other portions of the one or more images based on the intensities of the pixels.

In one aspect, the benchmark visual profile visually represents locations where the track is located prior to obtaining the one or more images.

In one aspect, the one or more computer processors also are configured to measure a distance between rails of the track by determining a number of pixels disposed between the rails in the one or more images.

In one aspect, the one or more computer processors are configured to compare the distance with a designated distance to identify a changing gauge of the segment of the track.

In one aspect, the one or more computer processors are configured to identify a switch in the segment of the track by identifying a change in the number of pixels disposed between the rails in the one or more images.

In one aspect, the one or more computer processors are configured to create the benchmark visual profile from at least one image of the one or more images that are compared to the benchmark visual profile to identify the one or more differences.

In one aspect, the one or more computer processors are configured to compare the one or more images of the segment of the track with one or more additional images of the segment of the track obtained by one or more other rail vehicles at one or more other times in order to identify degradation of the segment of the track.

In one aspect, the camera is configured to obtain the one or more images of the segment of the track and the one or more computer processors are configured to identify the misaligned segment of the track while the rail vehicle is traveling at an upper speed limit of the segment of the track.

In another example of the inventive subject matter described herein, a method (e.g., an optical route examining method) includes obtaining plural first images of an upcoming segment of a route with one or more cameras on a vehicle that is moving along the route, examining the first images with one or more computer processors to identify a foreign object on or near the upcoming segment of the route, identifying one or more differences between the first images with the one or more processors, determining if the foreign object is a transitory object or a persistent object based on the differences between the first images that are identified, and implementing one or more mitigating actions responsive to determining if the foreign object is the transitory object or the persistent object.

In one aspect, the method also includes increasing a magnification level of the one or more cameras to zoom in on the foreign object and obtaining one or more second images of the foreign object. The foreign object can be determined to be the persistent object responsive to a comparison between the first images and the one or more second images.

In one aspect, the first images are obtained at different times, and implementing the one or more mitigating actions includes prioritizing the one or more mitigating actions based on the differences in the first images obtained at the different times.

In one aspect, the method also includes calculating a depth of the foreign object and a distance from the vehicle to the foreign object based on comparisons of the first images and the second images.

In one aspect, implementing the one or more mitigating actions is performed based on whether the foreign object is the persistent object or the transitory object, a depth of the foreign object that is calculated by the one or more computer processors from the differences between the first images, and a distance from the vehicle to the foreign object that is calculated by the one or more computer processors from the differences between the first images.

In one aspect, the method also includes estimating a moving speed of the foreign object with the one or more computer processors from the differences between the first images.

In one aspect, the one or more cameras acquire the first images at a first frame rate and additional, second images at a different, second frame rate. The method can also include modifying at least one of the first frame rate or the second frame rate based on changes in a moving speed of the vehicle.

In one aspect, the method also includes comparing the first images with plural additional images of the route obtained by plural other vehicles at one or more other times in order to identify degradation of the route.

In another example of the inventive subject matter described herein, a system (e.g., an optical route examining system) includes one or more cameras configured to be mounted on a vehicle and to obtain plural first images of an upcoming segment of a route while the vehicle is moving along the route. The system also includes one or more computer processors configured to compare the first images with each other to identify differences between the first images, to identify a foreign object on or near the upcoming segment of the route based on the differences between the first images that are identified, to determine if the foreign object is a transitory object or a persistent object based on the differences between the first images that are identified, and to implement one or more mitigating actions responsive to determining if the foreign object is the transitory object or the persistent object.

In one aspect, the one or more computer processors also are configured to direct the one or more cameras to increase a magnification level of the one or more cameras to zoom in on the foreign object and obtaining one or more second images of the foreign object. The foreign object can be determined to be the persistent object by the one or more computer processors responsive to a comparison between the first images and the one or more second images.

In one aspect, the one or more computer processors direct the one or more cameras to obtain the first images at different times, and the one or more computer processors are configured to implement the one or more mitigating actions by prioritizing the one or more mitigating actions based on the differences in the first images obtained at the different times.

In one aspect, the one or more computer processors also are configured to calculate a depth of the foreign object and a distance from the vehicle to the foreign object based on comparisons of the first images.

In one aspect, the one or more computer processors are configured to implement the one or more mitigating actions based on whether the foreign object is the persistent object or the transitory object, a depth of the foreign object that is calculated by the one or more computer processors based on the differences between the first images, and a distance from the vehicle to the foreign object that is calculated by the one or more computer processors based on the differences between the first images.

In one aspect, the one or more computer processors are configured to estimate a moving speed of the foreign object from the differences between the first images.

In one aspect, the one or more cameras acquire the first images at a first frame rate and additional, second images at a different, second frame rate. The one or more computer processors also can be configured to modify at least one of the first frame rate or the second frame rate based on changes in a moving speed of the vehicle.

In one aspect, the one or more computer processors also are configured to compare the first images with plural additional images of the route obtained by plural other vehicles at one or more other times in order to identify degradation of the route.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended clauses, along with the full scope of equivalents to which such clauses are entitled. In the appended clauses, the terms "including" and "in which" are used as the plain-English equivalents of the respective terms "comprising" and "wherein." Moreover, in the following clauses, the terms "first," "second," and "third," etc. are used merely as labels, and are not intended to impose numerical requirements on their objects. Further, the limitations of the following clauses are not written in means-plus-function format and are not intended to be interpreted based on 35 U.S.C. § 112(f), unless and until such clause limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter may include other examples that occur to those of ordinary skill in the art. Such other examples are intended to be within the scope of the clauses if they have structural elements that do not differ from the literal language of the clauses, or if they include equivalent structural elements with insubstantial differences from the literal languages of the clauses.

The foregoing description of certain embodiments of the inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "an embodiment" or "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

The invention claimed is:

1. A method comprising:

obtaining one or more images of a segment of two rails of a track from a camera mounted to a rail vehicle while the rail vehicle is moving along the track, wherein the camera is disposed at a front end of the rail vehicle;

comparing, with one or more computer processors, the one or more images of the segment of the two rails of the track with a benchmark visual profile comprising designated areas of the segment of the track, the benchmark visual profile representing a designated gauge of the track, wherein comparing the one or more images of the segment of the two rails of the track with the benchmark visual profile includes overlaying the one or more images onto the designated areas of the benchmark visual profile or overlaying the designated areas of the benchmark visual profile onto the one or more images;

identifying, with the one or more computer processors, a misaligned segment of the track based on one or more differences between the one or more images and the designated areas of the benchmark visual profile; and implementing, with the one or more computer processors, a responsive action based on the misaligned segment of the track that is identified.

2. The method of claim 1, further comprising identifying portions of the one or more images that represent the track by measuring intensities of pixels in the one or more images and distinguishing the portions of the one or more images that represent the track from other portions of the one or more images based on the intensities of the pixels.

3. The method of claim 1, further comprising measuring a gauge between rails of the track by determining a number of pixels disposed between the two rails of the track in the one or more images.

4. The method of claim 3, further comprising identifying a switch in the segment of the track by identifying a change in the number of pixels disposed between the two rails in the one or more images.

5. The method of claim 1, further comprising creating the benchmark visual profile from at least one image of the one or more images that are compared to the benchmark visual profile to identify the one or more differences.

6. The method of claim 1, further comprising comparing the one or more images of the segment of the track with one or more additional images of the segment of the track obtained by one or more other rail vehicles at one or more other times in order to identify degradation of the segment of the track.

7. The method of claim 1, wherein the one or more images of the segment of the track are obtained while the rail vehicle is traveling at an upper speed limit of the segment of the track.

8. The method of claim 1, wherein the one or more images are obtained from the camera having a field of view ahead of a direction of travel of the rail vehicle.

9. The system of claim 1, wherein the camera is configured to capture the segment of the two rails of the track within a single image.

10. The system of claim 1, wherein the system includes only a single camera.

11. A system comprising:

a camera configured to be mounted to a rail vehicle and to obtain one or more images of a segment of two rails of a track while the rail vehicle is moving along the track, wherein the camera is disposed at a front end of the rail vehicle; and one or more computer processors configured to compare the one or more images of the segment of the two rails of the track with a benchmark visual profile comprising designated areas of the segment of the track, wherein comparing the one or more images of the segment of the two rails of the track with the benchmark visual profile includes overlaying the one or more images onto the designated areas of the benchmark visual profile or overlaying the designated areas of the benchmark visual profile onto the one or more images to identify a misaligned segment of the track based on one or more differences between the one or more images and the designated areas of the benchmark visual profile, the designated areas of the benchmark visual profile representing a designated gauge of the track, wherein the one or more computer processors are configured to implement a responsive action based on the misaligned segment of the track that is identified.

12. The system of claim 11, wherein the one or more computer processors are configured to identify portions of the one or more images that represent the track by measuring intensities of pixels in the one or more images and to distinguish the portions of the one or more images that represent the track from other portions of the one or more images based on the intensities of the pixels.

13. The system of claim 11, wherein the benchmark visual profile visually represents locations where the track is located prior to obtaining the one or more images.

14. The system of claim 11, wherein the one or more computer processors also are configured to measure a gauge between the two rails of the track by determining a number of pixels disposed between the rails in the one or more images.

15. The system of claim 14, wherein the one or more computer processors are configured to identify a switch in the segment of the track by identifying a change in the number of pixels disposed between the two rails in the one or more images.

16. The system of claim 11, wherein the one or more computer processors are configured to create the benchmark visual profile from at least one image of the one or more images that are compared to the benchmark visual profile to identify the one or more differences.

17. The system of claim 11, wherein the camera is configured to obtain the one or more images of the segment of the track and the one or more computer processors are configured to identify the misaligned segment of the track while the rail vehicle is traveling at an upper speed limit of the segment of the track.

18. The system of claim 11, wherein the camera is mounted to the rail vehicle such that a field of view of the camera is ahead of a direction of travel of the rail vehicle.

19. A method comprising:

obtaining plural first images of an upcoming segment of a route with one or more cameras on a vehicle that is moving along the route, wherein the one or more cameras are disposed at a front end of the vehicle;

examining the first images with one or more computer processors to identify a foreign object on or near the upcoming segment of the route;

identifying one or more differences between the first images with the one or more processors;

determining whether the foreign object is a transitory object or a persistent object based on the one or more differences between the first images that are identified;

selecting a mitigating action to implement responsive to determining whether the foreign object is the transitory object or the persistent object, the mitigating action selected from plural different mitigating actions based on a moving speed of the foreign object that is estimated from the one or more differences between the first images; and implementing the mitigating action that is selected from the plural different mitigating actions responsive to determining whether the foreign object is the transitory object or the persistent object.

20. The method of claim 19, further comprising increasing a magnification level of the one or more cameras to zoom in on the foreign object and obtaining one or more second images of the foreign object, wherein the foreign object is determined to be the persistent object responsive to a comparison between the first images and the one or more second images.

21. The method of claim 19, wherein the first images are obtained at different times, and wherein selecting the mitigating action includes prioritizing the plural different mitigating actions based on the one or more differences in the first images obtained at the different times.

22. A system comprising:

a camera configured to be mounted to a rail vehicle and to obtain one or more images of a segment of two rails of a track while the rail vehicle is moving along the track, wherein the camera is disposed at a front end of the rail vehicle; and one or more computer processors configured to compare the one or more images of the segment of the two rails of the track with a benchmark visual profile comprising designated areas of the segment of the track, wherein comparing the one or more images of the segment of the two rails of the track with the benchmark visual profile includes combining the one or more images with the designated areas of the benchmark visual profile or combining the designated areas of the benchmark visual profile with the one or more images to identify a misaligned segment of the track based on one or more differences between the one or more images and the designated areas of the benchmark visual profile, the benchmark visual profile representing a designated gauge of the track.

* * * * *